US009818558B2

(12) United States Patent
Saito

(10) Patent No.: US 9,818,558 B2
(45) Date of Patent: Nov. 14, 2017

(54) SNAP ACTION SWITCH

(71) Applicant: Satori S-Tech Co., Ltd., Tokyo (JP)

(72) Inventor: Masaaki Saito, Tokyo (JP)

(73) Assignee: SATORI S-TECH CO., LTD., Tokyo (JP)

( * ) Notice: Subject to any disclaimer, the term of this patent is extended or adjusted under 35 U.S.C. 154(b) by 0 days.

(21) Appl. No.: 15/170,015

(22) Filed: Jun. 1, 2016

(65) Prior Publication Data

US 2016/0358726 A1 Dec. 8, 2016

(30) Foreign Application Priority Data

Jun. 4, 2015 (JP) ..... 2015-113830
Jun. 4, 2015 (JP) ..... 2015-113832

(51) Int. Cl.

| | |
|---|---|
| ***H01H 13/02*** | (2006.01) |
| ***H01H 15/18*** | (2006.01) |
| ***H01H 13/28*** | (2006.01) |
| ***H01H 13/30*** | (2006.01) |
| ***B25F 5/02*** | (2006.01) |
| *H01H 1/20* | (2006.01) |

(Continued)

(52) U.S. Cl.

CPC ..... *H01H 15/18* (2013.01); *B25F 5/02* (2013.01); *H01H 13/28* (2013.01); *H01H 13/30* (2013.01); *H01H 1/20* (2013.01); *H01H 13/063* (2013.01); *H01H 13/08* (2013.01); *H01H 2009/065* (2013.01); *H01H 2013/066* (2013.01); *H01H 2231/048* (2013.01); *H01H 2235/01* (2013.01); *H01H 2300/048* (2013.01)

(58) Field of Classification Search

CPC ..... H01H 13/18; H01H 13/26; H01H 13/28; H01H 13/285; H01H 13/30; H01H 13/32; H01H 13/34

USPC ..... 200/405, 449, 453, 454, 457, 458, 461, 200/522

See application file for complete search history.

(56) References Cited

U.S. PATENT DOCUMENTS 2,598,856 A * 6/1952 Swan ..... H01H 13/365 200/447
6,469,268 B1 10/2002 Schaeffeler et al.

(Continued)

FOREIGN PATENT DOCUMENTS

DE 47975 7/1889
DE 1 890 265 4/1964

(Continued)

OTHER PUBLICATIONS

Extended European Search Report issued Jan. 4, 2017 in corresponding European Application No. 16171944.8.

(Continued)

*Primary Examiner* — Vanessa Girardi
(74) *Attorney, Agent, or Firm* — Wenderoth, Lind & Ponack, L.L.P.

(57) ABSTRACT

An actuator is allowed to move toward +A direction and toward −A direction. A movable contact engages with the actuator. A fixed contact touch the movable contact with electrical connection when the movable contact is located at an ON position, and are apart from the movable contact with electrical isolation when the movable contact is located at positions other than the ON position. An arc prevention mechanism prevents arc between the movable contact and the fixed contact.

7 Claims, 9 Drawing Sheets

(51) Int. Cl.

| | |
|---|---|
| *H01H 13/06* | (2006.01) |
| *H01H 13/08* | (2006.01) |
| *H01H 9/06* | (2006.01) |

(56) References Cited

U.S. PATENT DOCUMENTS

| | | | | |
|---|---|---|---|---|
| 9,099,263 | B2 * | 8/2015 | Orrico ..... | H01H 13/18 |
| 2006/0186102 | A1 | 8/2006 | Inagaki et al. | |
| 2012/0152713 | A1 | 6/2012 | Orricio | |

FOREIGN PATENT DOCUMENTS

| | | |
|---|---|---|
| DE | 36 28 423 | 2/1988 |
| EP | 1 936 645 | 6/2008 |
| JP | 56-057439 U | 5/1981 |
| JP | 2002-521800 | 7/2002 |
| JP | 2006-218560 | 8/2006 |

OTHER PUBLICATIONS

Partial European Search Report issued Oct. 25, 2016 in corresponding European Application No. 16 17 1944.8.

* cited by examiner

Fig. 9
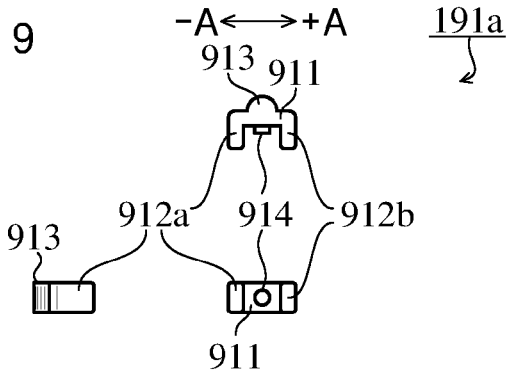
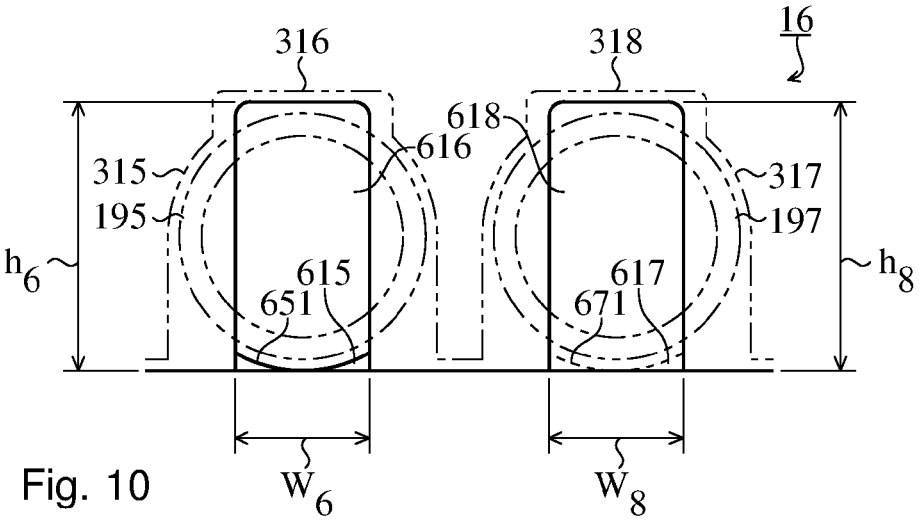
Fig. 10
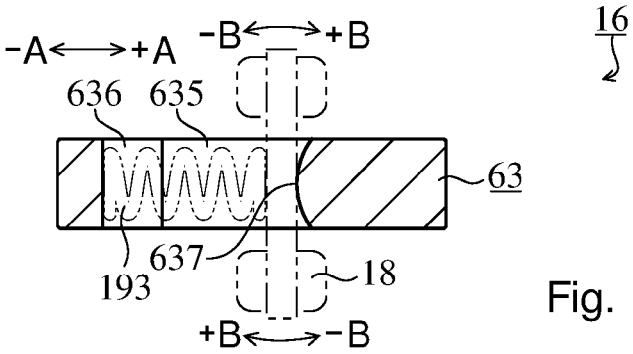
Fig. 11

SNAP ACTION SWITCH

Priority is claimed on Japanese Patent Applications Nos. 2015-113830 and 2015-113832, which are filed on Jun. 4, 2015, and the content of which is incorporated herein by reference.

TECHNICAL FIELD

The present invention is related to a switch such as a trigger switch used in a electric power tool or the like.

BACKGROUND ART

In order to prevent generation of arc in switching, there is known a quick movement mechanism accumulating energy in a helical compression spring and instantly releasing it, so as to rapidly move a movable contact.

For example, JP 56-57439 U discloses a slide switch provided with two helical compression springs at two sides of a contact holder. The slide switch realizes quick movement by accumulating energy in one of the helical compression springs, when the switch is being turned on. When the switch is being turned off, quick movement is realized by accumulating energy in the other of the helical compression springs, because force is required to be acted toward a direction opposite that in the switching-on case.

Also, the document discloses another slide switch provided with two protrusions at two sides of a helical compression spring accommodated in a spring supporting member. The slide switch accumulates energy by compressing the helical compression spring between one of the protrusions and the spring supporting member, when the switch is being turned on. When the switch is being turned off, force is acted toward the direction opposite that in the switching-on case, by compressing the helical compression spring between the other of the protrusions and the spring supporting member to accumulate energy.

JP 2002-521800 A discloses a slide switch provided with extension parts at two sides of a second spring accommodated in a receptacle. The slide switch accumulates energy by compressing the second spring between one of the extension parts and the receptacle in the switching-on case. In the switching-off case, force is acted toward the direction opposite that in the switching-on case, by compressing the second spring between the other of the extension parts and the receptacle to accumulate energy.

There is also known a switch restraining a movable contact from bouncing in order to prevent generation of arc in switching.

JP 2006-218560 A discloses a trigger switch for flowing regeneration current to brake a motor, by means of shorting between ends of the motor or the like, in order to stop continuous rotation of the motor caused by inertia when the switch of the motor is turned off. The trigger switch prevents bouncing by biasing the movable contact by using a contact supporting spring in a switching-on case. In a switching-off case, bouncing is prevented by biasing a sliding frame including the movable contact by a sliding frame spring toward a direction opposite that in a switching-on case.

SUMMARY OF INVENTION

Technical Problem

Miniaturization of an electric power tool requires to downsize a trigger switch. Secure prevention of arc requires to accumulate as large energy as possible in the helical compression spring to move the movable contact as rapidly as possible. This hinders the helical compression spring from being so shortened.

The configuration where the helical compression springs are provided at the two sides of the contact holder, makes an operation member long in a movement direction. This makes it difficult to downsize the trigger switch.

The configuration where the spring supporting member, or the receptacle, accommodates the helical compression spring, or the second spring, and the helical compression spring is compressed between it and the protrusion, or the extension part, makes the operation member, or a sliding member, shorter in the movement direction, because the number of the helical compression springs decreases to one. However, it is required to provide spaces, where the protrusions move against the spring supporting member, at the two sides of the helical compression spring. This elongates the operation member in the movement direction, and thereby makes it difficult to downsize the trigger switch.

The configuration where the two springs bias the movable contact, elongates an assembly including the movable contact in the movement direction. This makes it difficult to downsize the trigger switch.

The present invention aims to downsize a switch with secure prevention of arc.

Solution to Problem

A switch according to the present invention includes: an actuator, allowed to move toward an ON direction and toward an OFF direction opposite the ON direction; a movable contact, engaging with the actuator; a fixed contact, configured to touch the movable contact with electrical connection when the movable contact is located at an ON position, and to be apart from the movable contact with electrical isolation when the movable contact is located at positions other than the ON position; and an arc prevention mechanism, configured to prevent generation of arc between the movable contact and the fixed contact.

The switch may further include a plunger, allowed to move toward the ON direction and toward the OFF direction.

The actuator may engage with the plunger to be allowed to move toward the ON direction and toward the OFF direction against the plunger.

The arc prevention mechanism may include: a quick ON spring, composed of a helical compression spring to bias the actuator toward the ON direction against the plunger; a quick OFF spring, composed of a helical compression spring to bias the actuator toward the OFF direction against the plunger; and a restriction mechanism, configured to restrict movement of the actuator before the actuator passes over a switching position, and to release the actuator after the actuator passes over the switching position.

The plunger may include: a quick ON spring accommodation part, accommodating the quick ON spring; a quick ON projection accommodation part, disposed in the ON direction against the quick ON spring accommodation part; a quick OFF spring accommodation part, disposed in a direction different from the ON direction and the OFF direction against the quick ON spring accommodation part, and accommodating the quick OFF spring; and a quick OFF projection accommodation part, disposed in the OFF direction against the quick OFF spring accommodation part.

The actuator may include: a quick ON projection, accommodated in the quick ON projection accommodation part with being allowed to move toward the ON direction and the OFF direction, and biased toward the ON direction by the quick ON spring; and a quick OFF projection, accommodated in the quick OFF projection accommodation part with being allowed to move toward the ON direction and the OFF direction, and biased toward the OFF direction by the quick OFF spring.

The quick ON projection may be a protrusion protruding toward a direction different from the ON direction and the OFF direction, and may have a roughly rectangular parallelepiped shape, a width smaller than a diameter of the quick ON spring, and a height larger than the diameter of the quick ON spring.

The quick OFF projection may be a protrusion protruding toward a direction different from the ON direction and the OFF direction, and may have a roughly rectangular parallelepiped shape, a width smaller than a diameter of the quick OFF spring, and a height larger than the diameter of the quick OFF spring.

The quick ON projection accommodation part may be a concavity with an opening in a direction opposite the direction toward which the quick ON projection protrudes, and may have a width smaller than the diameter of the quick ON spring.

The quick OFF projection accommodation part may be a concavity with an opening in a direction opposite the direction toward which the quick OFF projection protrudes, and may have a width smaller than the diameter of the quick OFF spring.

The quick ON spring accommodation part may be a concavity with an opening in a direction roughly the same as the direction of the opening of the quick ON projection accommodation part, may have a depth roughly the same as that of the quick ON projection accommodation part, and may include: quick ON spring accommodation inner wall faces, having a distance between them roughly the same as the diameter of the quick ON spring; quick ON spring supporting inner wall faces, continuously extending inward from the quick ON spring accommodation inner wall faces, and curving along an outer periphery of the quick ON spring with a roughly circular column shape; and quick ON projection reception inner wall faces, continuously extending further inward from the quick ON spring accommodation inner wall faces, and having a distance between them roughly the same as the width of the quick ON projection accommodation part.

The quick OFF spring accommodation part may be a concavity with an opening in a direction roughly the same as the direction of the opening of the quick OFF projection accommodation part, may have a depth roughly the same as that of the quick OFF projection accommodation part, and may include: quick OFF spring accommodation inner wall faces, having a distance between them roughly the same as the diameter of the quick OFF spring; quick OFF spring supporting inner wall faces, continuously extending inward from the quick OFF spring accommodation inner wall faces, and curving along an outer periphery of the quick OFF spring with a roughly circular column shape; and quick OFF projection reception inner wall faces, continuously extending further inward from the quick OFF spring accommodation inner wall faces, and having a distance between them roughly the same as the width of the quick OFF projection accommodation part.

The actuator may include: a quick ON spring supporting part, being a protrusion disposed in the OFF direction against the quick ON projection, protruding toward a direction roughly the same as the direction toward which the quick ON projection protrudes, and having a width roughly the same as the width of the quick ON projection, and an upper face recessed along the outer periphery of the quick ON spring with a roughly circular cylindrical shape; and a quick OFF spring supporting part, being a protrusion disposed in the ON direction against the quick OFF projection, protruding toward a direction roughly the same as the direction toward which the quick OFF projection protrudes, and having a width roughly the same as the width of the quick OFF projection, and an upper face recessed along the outer periphery of the quick OFF spring with a roughly circular cylindrical shape.

The switch may further include: a second fixed contact, configured to touch the movable contact to be electrically connected with the fixed contact via the movable contact when the movable contact is located at the ON position, and to be apart from the movable contact to be electrically isolated from the movable contact and the fixed contact when the movable contact is located at positions other than the ON position; an OFF fixed contact, configured to touch the movable contact with electrical connection when the movable contact is located at an OFF position in the OFF direction against the ON position, and to be apart from the movable contact with electrical isolation when the movable contact is located at positions other than the OFF position; and a second OFF fixed contact, configured to touch the movable contact to be electrically connected with the OFF fixed contact via the movable contact when the movable contact is located at the OFF position, and to be apart from the movable contact to be electrically isolated from the movable contact and the OFF fixed contact when the movable contact is located at positions other than the OFF position.

The arc prevention mechanism may include a holding spring, composed of a helical compression spring, biasing the movable contact toward the ON direction against the actuator, to hold the movable contact in the ON position when the actuator is located in the ON direction of the switching position.

The actuator may include an actuator plate, intervening between the fixed contact and the second fixed contact and between the OFF fixed contact and the second OFF fixed contact, The actuator plate may include: a holding spring accommodation part, accommodating the holding spring; and a penetrating hole, disposed in the ON direction against the holding spring accommodation part, the movable contact inserted through the penetrating hole.

The movable contact may be allowed to swing around a fulcrum in the ON direction against the holding spring when the movable contact touches an inner wall face in the ON direction of the penetrating hole by being biased by the holding spring.

The penetrating hole may include a ridge part, swollen toward the OFF direction from the inner wall face in the ON direction, and functioning as the fulcrum of the swing of the movable contact.

Advantageous Effects of Invention

According to the present invention, the arc prevention mechanism preventing generation of arc enables to downsize the switch.

A quick OFF mechanism, such as the quick OFF spring and the quick OFF projection, disposed the direction different from the ON direction and the OFF direction against a quick ON mechanism, such as the quick ON spring and the quick ON projection, enables to shorten a length of the whole of the quick movement mechanism including the quick ON mechanism and the quick OFF mechanism. This achieves secure prevention of generation of arc, as well as downsizing of the trigger switch.

The quick ON and quick OFF spring supporting parts of the quick ON and quick OFF spring accommodation parts supporting the quick ON and quick OFF springs, the height of the quick ON and quick OFF projections greater than the diameter of the quick ON and quick OFF spring, and spaces, for receiving the quick ON and quick OFF projections, provided on a bottom of the quick ON and quick OFF spring accommodation parts enable to securely hold the quick ON and quick OFF springs, as well as enable ends of the quick ON and quick OFF projections to touch ends of the quick ON and quick OFF springs at two areas. This realizes biasing force by the quick ON and quick OFF springs to act straightly toward the ON direction and the OFF direction. This enables the quick ON and quick OFF mechanisms to securely work without the quick ON and quick OFF mechanisms disposed on a central axis of the trigger switch.

The quick ON and quick OFF spring supporting parts provided on the actuator enable to securely hold the quick ON and quick OFF springs. This achieves more secure function of the quick ON and quick OFF mechanisms.

The holding spring biasing the movable contact toward the ON direction and pressing it against the ON fixed contacts enables to prevent bouncing and also generation of arc in the switching-on case. The movable contact allowed to swing around a fulcrum in the ON direction against the holding spring enables to absorb a difference between positions of the two OFF fixed contact by swinging of the movable contact in the switching-off case. This achieves to prevent bouncing and also generation of arc. The switch can be downsized because no spring for biasing the movable contact toward the OFF direction is required.

The ridge part swollen toward the OFF direction from the inner wall face in the ON direction of the penetrating hole enables easily to allow the movable contact to swing. This achieves to securely prevent generation of arc, and to downsize the switch.

BRIEF DESCRIPTION OF DRAWINGS

FIG. 9 shows a plan view, a front view and a right side view of a actuator tip;

FIG. 10 shows an expanded front view of a quick ON projection and a quick OFF projection;

FIG. 11 shows an expanded sectional plan view of an actuator plate;

DESCRIPTION OF EMBODIMENT

Figure 1:
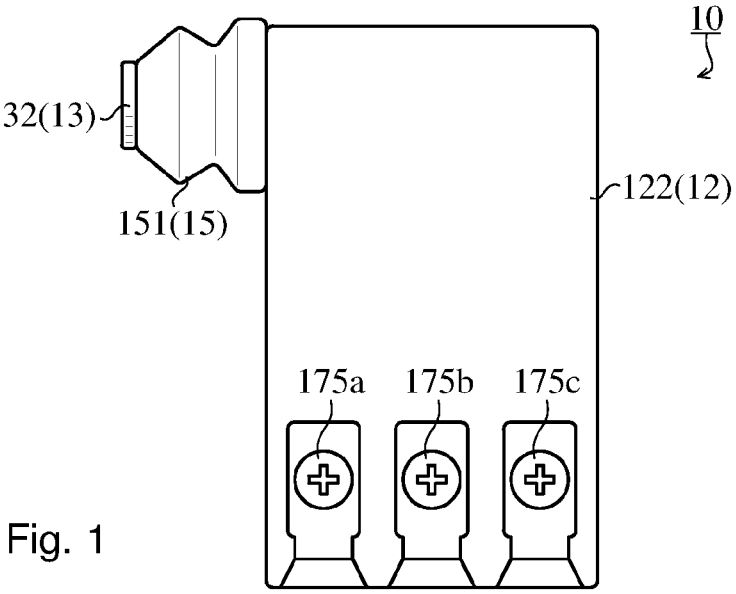
FIG. 1 shows a right side view of appearance of a trigger switch.

A trigger switch 10 shown in FIG. 1 is a switch mounted in a electric power tool or the like, for turning a rotation of a motor on and off.

Figure 2:
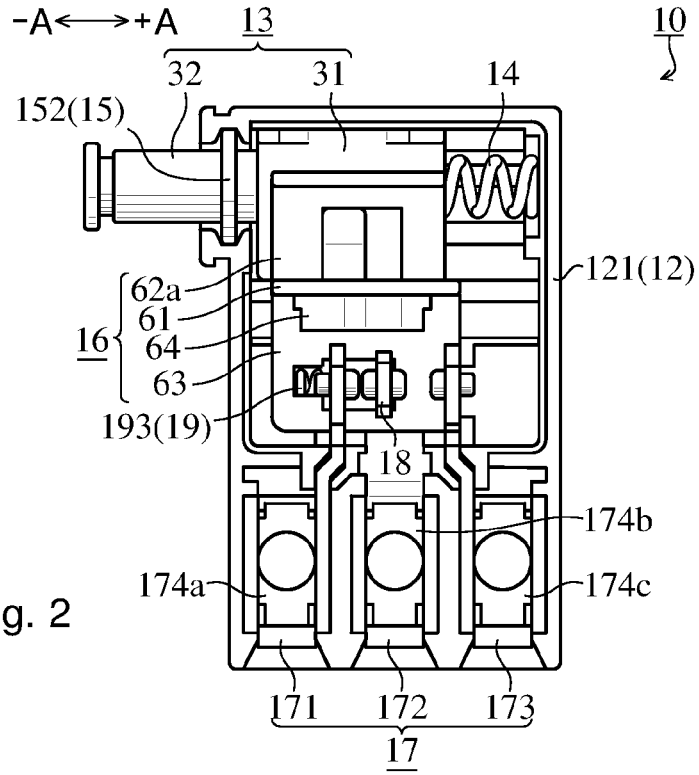
FIG. 2 shows a right side view of the trigger switch without a packing and a cover.

As shown in FIG. 2, the trigger switch 10 includes the followings.

(1) A case 12. It has a roughly rectangular parallelepiped box shape, and is formed by fitting a case body 121 and a cover 122, shown in FIG. 1.

(2) A plunger 13. It includes a plunger body 31 with a roughly rectangular parallelepiped shape, and an operation part 32 with a roughly circular column shape. The plunger body 31 is disposed in the case 12. The operation part 32 is exposed outside the case 12. When an user pulls a trigger of the electric power tool, the operation part 32 is pushed toward +A direction, or an ON direction, the whole of the plunger 13 moves toward +A direction.

(3) A return spring 14. It is composed of a helical compression spring, disposed between the case 12 and the plunger 13 to bias the plunger 13 against the case 12 toward −A direction, or an OFF direction, which is a direction opposite the +A direction. When the user releases the trigger of the electric power tool, or weakens a force of pulling the trigger, a force of the return spring 14 moves the plunger 13 toward −A direction.

(4) A dustproof mechanism 15. It is composed of a packing 151, shown in FIG. 1, a sponge 152 or the like, for example. It prevents dust, water or the like from invading the interior of the case 12 through an opening for exposing the operation part 32 of the plunger 13 outside the case 12.

Figure 7:
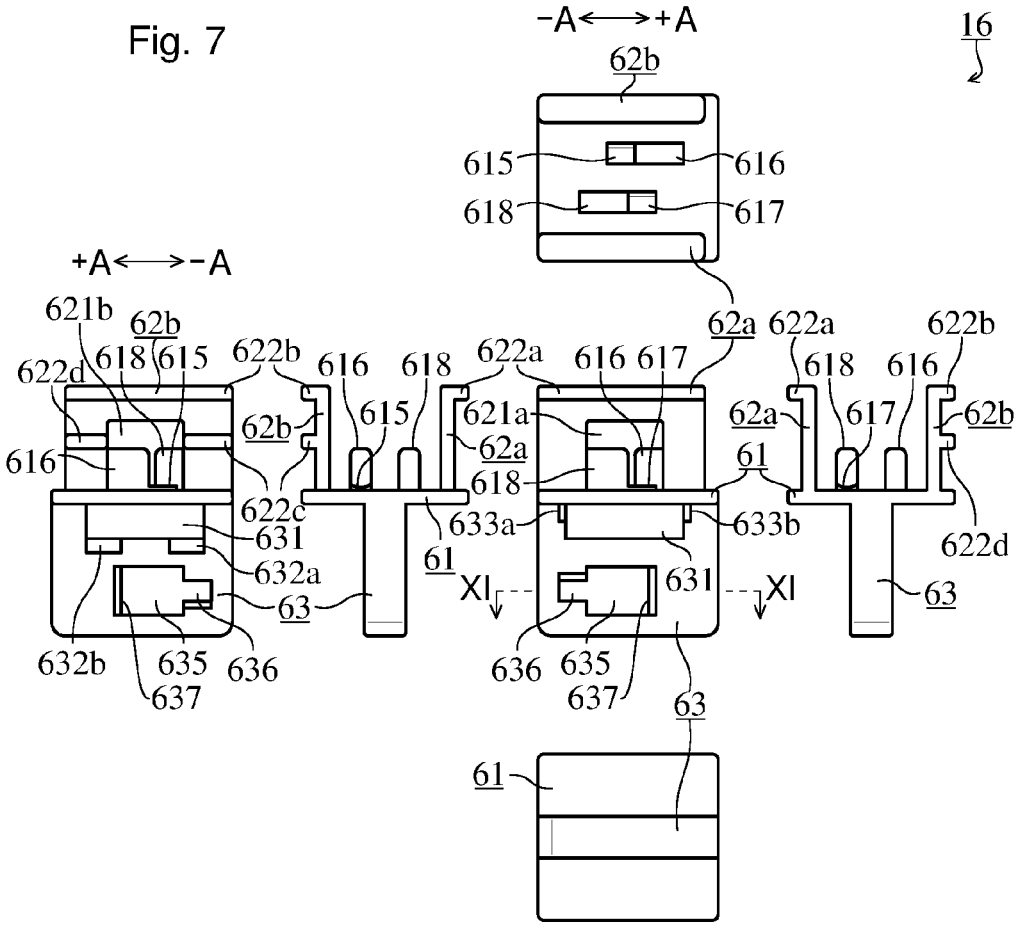
FIG. 7 shows a plan view, a left side view, a front view, a right side view, a back view and a bottom view of an actuator without a sliding part.

(5) An actuator 16. It includes:

an actuator body 61, with a roughly flat plate shape and disposed along a bottom face of the plunger body 31;

actuator upper parts 62*a* and 62*b*, shown in FIG. 7, with roughly rectangular frame shapes and protruding upward from the actuator body 61;

an actuator plate 63, with a roughly flat plate shape and protruding downward from the actuator body 61; and a sliding part 64, press-fitted to the actuator plate 63.

The actuator upper parts 62*a* and 62*b* engage with the plunger body 31. The whole of the actuator 16 moves toward ±A directions, accompanying movement of the plunger 13, with being allowed to relatively move within a predetermined span in ±A directions against the plunger 13.

(6) A terminal part 17. It includes:

an OFF terminal 171, a common terminal 172 and an ON terminal 173, which are fixed to the case 12;

connection metals 174*a* to 174*c*, engaging with these terminals 171 to 173; and connection screws 175*a* to 175*c*, shown in FIG. 1, screwed to the case 12.

It is used for being connected with wires connected to an electric power source, the motor or the like. The wires are inserted between the terminals 171 to 173 and the connection metals 174*a* to 174*c*, and then the connection screws 175*a* to 175*c* are tightened. Thereby, the wires are fixed and electrically connected to the terminals 171 to 173.

(7) A movable contact 18. It engages with the actuator 16, and moves toward ±A directions, accompanying movement of the actuator 16, with being allowed to relatively move within a predetermined span in ±A directions against the actuator 16. The movable contact 18 moves between an OFF position and an ON position. When located at the OFF position, it bridges between the OFF terminal 171 and the common terminal 172. When located at the ON position, it bridges between the ON terminal 173 and the common terminal 172.

The electric power tool having the trigger switch 10 is configured to supply electric current from the electric power source to the motor so as to rotate the motor when the ON terminal 173 and the common terminal 172 are bridged. When the OFF terminal 171 and the common terminal 172 are bridged, two ends of the motor are shorted, so as to flow regeneration current, to brake the rotation of the motor, and to promptly stop the rotation of the motor. And, (8) A quick movement mechanism 19. It includes, for example, actuator tips 191*a* and 191*b*, shown in FIG. 9, restriction springs 192*a* and 192*b*, shown in FIG. 16, a holding spring 193, a quick ON spring 195, shown in FIG. 16, a quick OFF spring 197, show in FIG. 16, and the like. It forces the movable contact 18 to rapidly move from the OFF position to the ON position when the plunger 13 moves toward +A direction and passes over a predetermined position. It also forces the movable contact 18 to rapidly move from the ON position to the OFF position when the plunger 13 moves toward −A direction and passes over a predetermined position.

Figure 3:
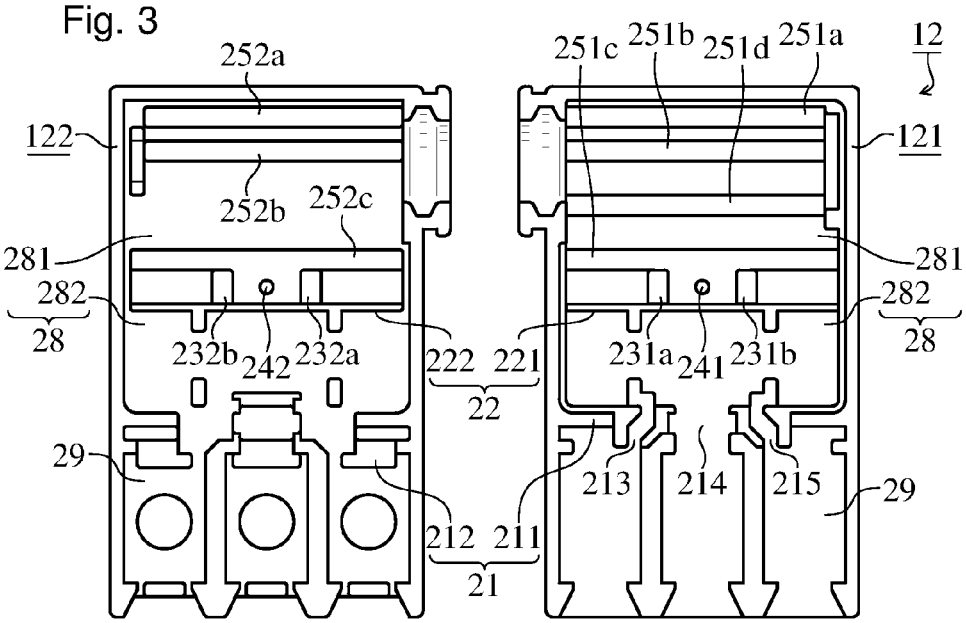
FIG. 3 shows side views of inside of a case body and the cover.

As shown in FIG. 3, the case 12 includes the followings.

(1) A partition 21. It is formed by combining a partition part 211 of the case body 121 and a partition part 212 of the cover 122. It separates inside of the case 12 into a switch room 28 and a wire room 29. The partition parts 211 and 212 protrude inward from left and right side walls of the case 12. The switch room 28 accommodates the plunger body 31 of the plunger 13, the actuator 16 and the like. The wire room 29 accommodates part of the terminal part 17, with which the wires are connected. The partition 21 has passages 213 to 215 through which the terminals 171 to 173 pass. In order to prevent dust or water from invading the switch room 28 through the passages 213 to 215, the passages 213 to 215 are formed with a labyrinth shape, instead of with a straight shape. Furthermore, the terminals 171 to 173 are press-fitted into the passages 213 to 215. This prevents generation of gaps between the terminals 171 to 173 and the passages 213 to 215.

(2) A partition 22. It is formed by a partition part 221 of the case body 121 and a partition part 222 of the cover 122. It separates the switch room 28 further into a plunger room 281 and a contact room 282. The partition part 221 and 222 protrude inward from the left and right side walls of the case 12, and face each other across a gap. The plunger room 281 accommodates the plunger body 31 of the plunger 13, the actuator body 61, the actuator upper parts 62*a* and 62*b*, and sliding part 64 of the actuator 16, and the like. The contact room 282 accommodates the movable contact 18 and the like. The actuator plate 63 of the actuator 16 passes through the gap between the partition parts 221 and 222, and extends from the plunger room 281 to the contact room 282

(3) Actuator tip supporting parts 231*a*, 231*b*, 232*a* and 232*b*. Each of them is a protrusion with a roughly rectangular parallelepiped shape, protruding inward from the left or right side walls of the case 12, and adjoining an upper side of the partition 22. They support the actuator tips 191*a* and 191*b*, shown in FIG. 9, of the quick movement mechanism 19 from ±A directions.

(4) Restriction spring supporting parts 241 and 242. Each of them is a protrusion with a roughly circular column shape, protruding inward from the left or right side walls of the case 12, and disposed between the actuator tip supporting part 231*a* and 231*b*, or between the actuator tip supporting part 232*a* and 232*b*. They support the restriction springs 192*a* and 192*b*, shown in FIG. 16, of the quick movement mechanism 19. And, (5) guide grooves 251*a* to 251*d* and 252*a* to 252*c*. Each of them is a groove with a linear shape parallel to ±A directions, provided inside the left or right side walls of the case 12. They guide movement of the plunger 13 and the actuator 16 in ±A directions. The guide grooves 251*a* and 252*a* are disposed at an upper end of the plunger room 281. The guide grooves 251*b* and 252*b* are disposed below the guide grooves 251*a* and 252*a*. The guide grooves 251*c* and 252*c* are disposed just above the actuator tip supporting part 231*a*, 231*b*, 232*a* and 232*b*. The guide groove 251*d* is disposed between the guide grooves 251*b* and 251*c*. The cover 122 has no guide groove at a position corresponding to the guide groove 251*d* of the case body 121.

Figure 4:
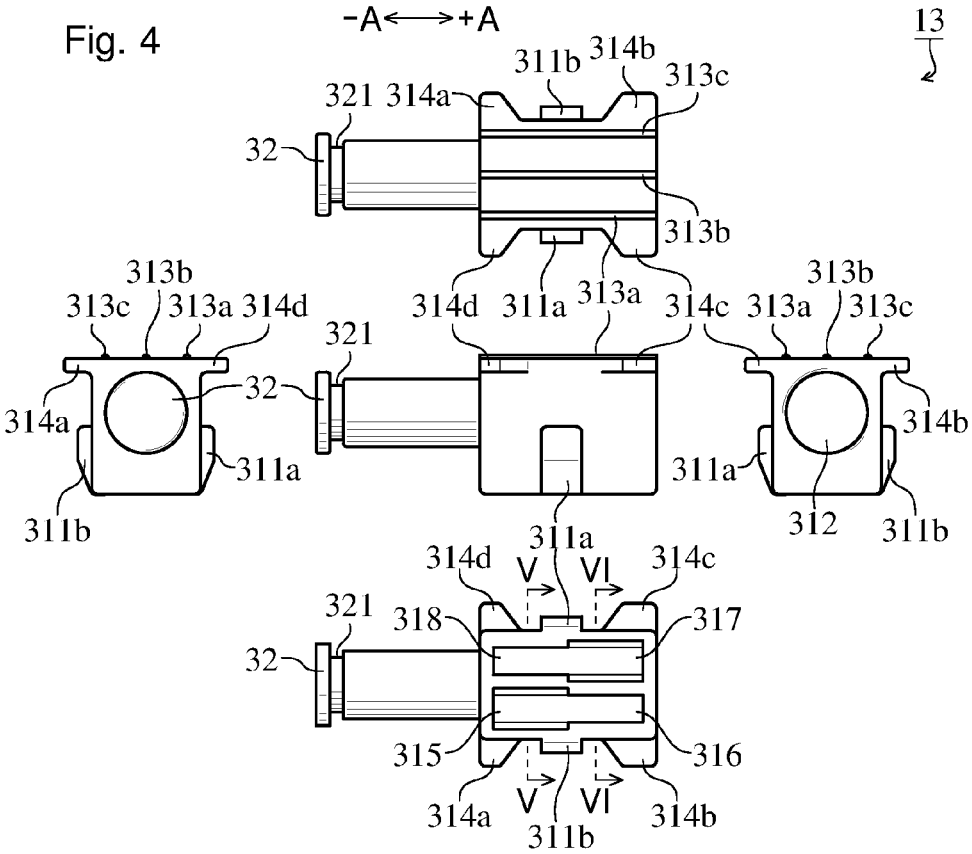
FIG. 4 shows a plan view, a front view, a right side view, a back view and a bottom view of a plunger.

As shown in FIG. 4, the plunger 13 includes the followings.

(1) Engagement protrusions 311*a* and 311*b*. Each of them is a protrusion protruding from the side faces of the plunger body 31 near its lower side, toward left or right directions. They engage with engagement openings 621*a* and 621*b*, shown in FIG. 7, of the actuator 16.

(2) A return spring accommodation part 312. It is a concavity with roughly circular column shape, recessed from a rear face, or a face in +A direction, of the plunger body 31 toward −A direction. It accommodates the return spring 14.

(3) Slide projection strips 313*a* to 313*c*. Each of them is a linear protrusion roughly parallel to ±A directions, protruding upward from an upper face of the plunger body 31. They touch an inner face of an upper wall of the case 12 so as to reduce an surface where the upper face of the plunger body 31 touches the case 12. This reduces sliding friction along with movement of the plunger 13 to prevent abrasion of the upper face of the plunger body 31.

(4) Guide wings 314*a* to 314*d*. Each of them is a protrusion protruding from the side faces of the plunger body 31 at those upper ends toward the left or right directions. Those distal ends engage with the guide grooves

251*a* and 252*a* of the case 12 so as to guide movement of the plunger 13 toward ±A directions.

(5) A quick ON spring accommodation part 315. It is a concavity recessed upward from a lower face of the plunger body 31. It accommodates a quick ON spring 195, shown in FIG. 16, of the quick movement mechanism 19.

(6) A quick ON projection accommodation part 316. It is a concavity recessed upward from the lower face of the plunger body 31, disposed in +A direction against the quick ON spring accommodation part 315 communicating with it. It accommodates a quick ON projection 616, shown in FIG. 7, of the actuator 16.

(7) A quick OFF spring accommodation part 317. It is a concavity recessed upward from the lower face of the plunger body 31. It accommodates a quick OFF spring 197, shown in FIG. 16, of the quick movement mechanism 19. And, (8) a quick OFF projection accommodation part 318. It is a concavity recessed upward from the lower face of the plunger body 31, disposed in −A direction against the quick OFF spring accommodation part 317 communicating with it. It accommodates a quick OFF projection 618, shown in FIG. 7, of the actuator 16.

The quick ON spring accommodation part 315 and the quick ON projection accommodation part 316 are disposed parallel to the quick OFF spring accommodation part 317 and the quick OFF projection accommodation part 318 in left and right directions. It is important that they are not disposed linearly in ±A directions. That is, the quick OFF spring accommodation part 317 is located in a direction different from ±A directions against the quick ON spring accommodation part 315. This makes a required length in ±A directions shorter. This enables to downsize the trigger switch 10. Especially, the shortest length of the trigger switch in ±A directions can be achieved, when the quick OFF projection accommodation part 318 is disposed right beside the quick ON spring accommodation part 315 and the quick OFF spring accommodation part 317 is disposed right beside the quick ON projection accommodation part 316, as shown in this example.

Figure 5:
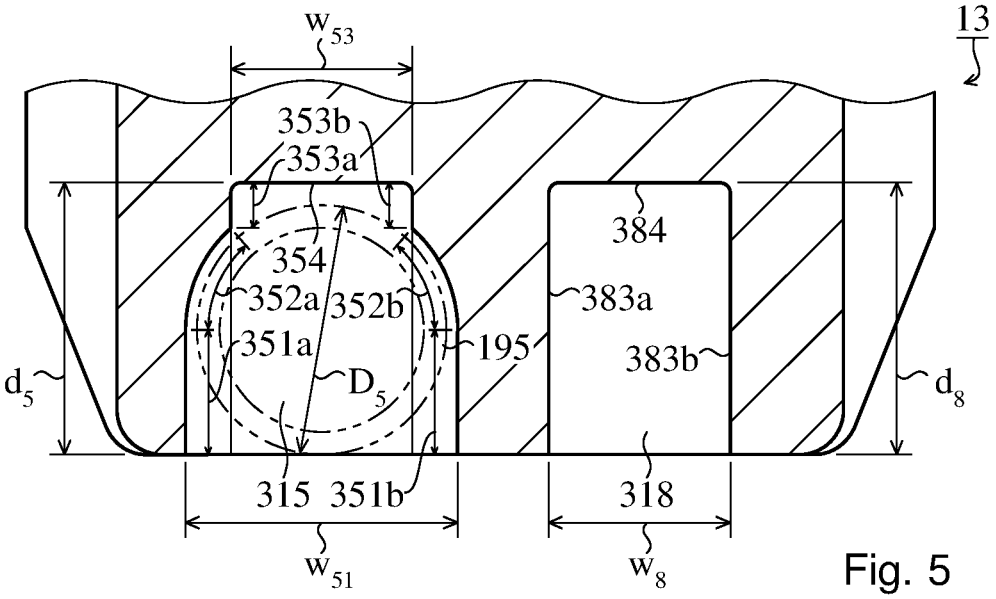
FIG. 5 shows an expanded sectional front view along V-V line of the plunger.

As shown in FIG. 5, the quick OFF projection accommodation part 318 has left and right inner wall faces 383*a* and 383*b* with flat planes roughly parallel to each other.

The quick ON spring accommodation part 315 has a depth $d_5$ greater than a diameter $D_5$ of the quick ON spring 195 accommodated in the quick ON spring accommodation part 315. The quick ON spring accommodation part 315 has left and right inner wall faces composed of quick ON spring accommodation inner wall faces 351*a* and 351*b*, quick ON spring supporting inner wall faces 352*a* and 352*b*, and quick ON projection reception inner wall faces 353*a* and 353*b*, continuously from the bottom in order. The quick ON spring accommodation inner wall faces 351*a* and 351*b* have flat planes roughly parallel to each other. A distance $w_{51}$ between them is slightly greater than the diameter $D_5$. The quick ON spring supporting inner wall faces 352*a* and 352*b* have recessed faces with circular column side face shapes bent along an outer periphery of the quick ON spring 195. Diameters of them are equal to the distance $w_{51}$. The quick ON projection reception inner wall faces 353*a* and 353*b* have flat planes roughly parallel to each other. A distance $w_{53}$ between them is less than the diameter $D_5$. Thereby, the quick ON spring 195 is supported and held by the quick ON spring supporting inner wall faces 352*a* and 352*b*, and inhibited from entering above them.

Figure 6:
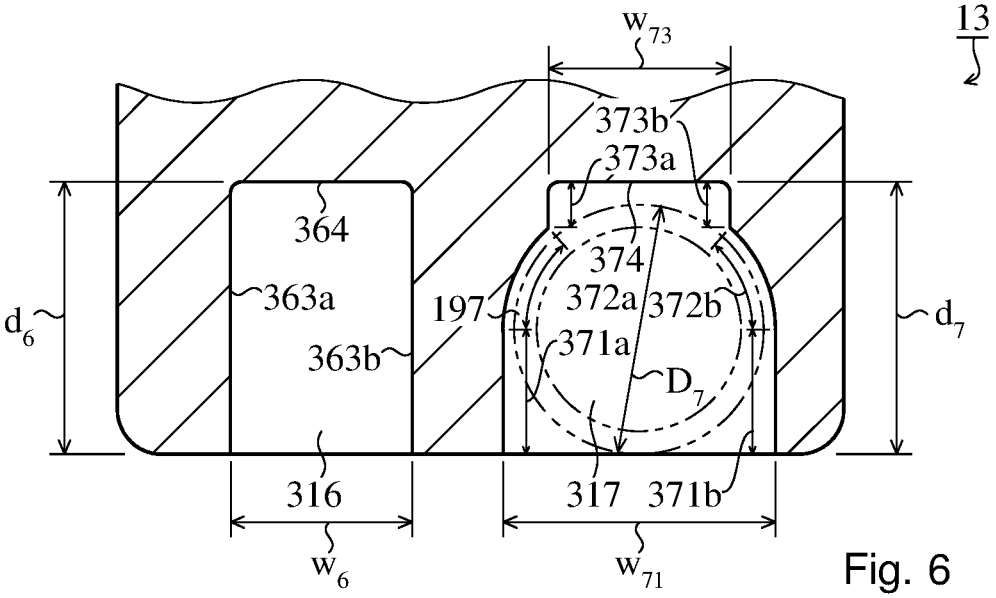
FIG. 6 shows an expanded sectional front view along VI-VI line of the plunger.

As shown in FIG. 6, the quick ON projection accommodation part 316 has left and right inner wall faces 363*a* and 363*b* with flat planes roughly parallel to each other.

The quick OFF spring accommodation part 317 has roughly the same shape as the quick ON spring accommodation part 315. The quick OFF spring accommodation part 317 has a depth $d_7$ greater than a diameter $D_7$ of the quick OFF spring 197 accommodated in the quick OFF spring accommodation part 317. The quick OFF spring accommodation part 317 has left and right inner wall faces composed of quick OFF spring accommodation inner wall faces 371*a* and 371*b*, quick OFF spring supporting inner wall faces 372*a* and 372*b*, and quick OFF projection reception inner wall faces 373*a* and 373*b*, continuously from the bottom in order. The quick OFF spring accommodation inner wall faces 371*a* and 371*b* have flat planes roughly parallel to each other. A distance $w_{71}$ between them is slightly greater than the diameter $D_7$. The quick OFF spring supporting inner wall faces 372*a* and 372*b* have recessed faces with circular column side face shapes bent along an outer periphery of the quick OFF spring 197. Diameters of them are equal to the distance $w_{71}$. The quick OFF projection reception inner wall faces 373*a* and 373*b* have flat planes roughly parallel to each other. A distance $w_{73}$ between them is less than the diameter $D_7$. Thereby, the quick OFF spring 197 is supported and held by the quick OFF spring supporting inner wall faces 372*a* and 372*b*, and inhibited from entering above them.

The quick ON spring accommodation part 315 has a depth $d_5$ roughly equal to a depth $d_6$ of the quick ON projection accommodation part 316, and a bottom face 354 continuously extending from a bottom face 364 of the quick ON projection accommodation part 316. The distance $w_{53}$ between the quick ON projection reception inner wall faces 353*a* and 353*b* is roughly equal to a width $w_6$ of the quick ON projection accommodation part 316. The quick ON projection reception inner wall faces 353*a* and 353*b* continuously extends from left and right inner wall faces 363*a* and 363*b* of the quick ON projection accommodation part 316. Thereby, the quick ON spring 195, accommodated in the quick ON spring accommodation part 315, is inhibited from entering into the quick ON projection accommodation part 316. The quick ON spring accommodation part 315 has a length less than a natural length of the quick ON spring 195. The quick ON spring 195 is compressed and accommodated in the quick ON spring accommodation part 315.

In the same manner, the quick OFF spring accommodation part 317 has a depth $d_7$ roughly equal to a depth $d_8$ of the quick OFF projection accommodation part 318, and a bottom face 374 continuously extending from a bottom face 384 of the quick OFF projection accommodation part 318. The distance $w_{73}$ between the quick OFF projection reception inner wall faces 373*a* and 373*b* is roughly equal to a width $w_8$ of the quick OFF projection accommodation part 318. The quick OFF projection reception inner wall faces 373*a* and 373*b* continuously extends from left and right inner wall faces 383*a* and 383*b* of the quick OFF projection accommodation part 318. Thereby, the quick OFF spring 197, accommodated in the quick OFF spring accommodation part 317, is inhibited from entering into the quick OFF projection accommodation part 318. The quick OFF spring accommodation part 317 has a length less than a natural length of the quick OFF spring 197. The quick OFF spring 197 is compressed and accommodated in the quick OFF spring accommodation part 317.

As shown in FIG. 7, the actuator 16 includes the followings.

(1) A quick ON projection 616. It is a protrusion with a roughly rectangular parallelepiped shape, protruding upward from an upper face of the actuator body 61, and accommodated in the quick ON projection accommodation part 316 of the plunger 13. The quick ON projection 616 has a length in ±A directions less than a length in ±A directions of the quick ON projection accommodation part 316. Since the plunger 13 has the quick ON spring accommodation part 315 communicating in −A direction with the quick ON projection accommodation part 316, the quick ON projection 616 enters into the quick ON spring accommodation part 315 when the actuator 16 relatively moves to −A direction against the plunger 13. This makes the quick ON projection 616 biased by the quick ON spring 195, accommodated in the quick ON spring accommodation part 315, toward +A direction against the plunger 13. In contrast, when the actuator 16 relatively moves to +A direction against the plunger 13, the quick ON projection 616 touches an inner wall face in +A direction of the quick ON projection accommodation part 316. This blocks the actuator 16 from further moving toward +A direction against the plunger 13.

(2) A quick ON spring supporting part 615. It is a protrusion protruding upward from the upper face of the actuator body 61, disposed in −A direction against the quick ON projection 616 linked with it. It supports from beneath the quick ON spring 195 accommodated in the quick ON spring accommodation part 315 of the plunger 13.

(3) A quick OFF projection 618. It is a protrusion with a roughly rectangular parallelepiped shape, protruding upward from the upper face of the actuator body 61, and accommodated in the quick OFF projection accommodation part 318 of the plunger 13. The quick OFF projection 618 has a length in ±A directions less than a length in ±A directions of the quick OFF projection accommodation part 318. Since the plunger 13 has the quick OFF spring accommodation part 317 communicating in +A direction with the quick OFF projection accommodation part 318, the quick OFF projection 618 enters into the quick OFF spring accommodation part 317 when the actuator 16 relatively moves to +A direction against the plunger 13. This makes the quick OFF projection 618 biased by the quick OFF spring 197 accommodated in the quick OFF spring accommodation part 317 toward −A direction against the plunger 13. In contrast, when the actuator 16 relatively moves to −A direction against the plunger 13, the quick OFF projection 618 touches an inner wall face in −A direction of the quick OFF projection accommodation part 318. This blocks the actuator 16 from further moving toward −A direction against the plunger 13.

(4) A quick OFF spring supporting part 617. It is a protrusion protruding upward from the upper face of the actuator body 61, and disposed in +A direction against the quick OFF projection 618 linked with it. It supports from beneath the quick OFF spring 197 accommodated in the quick OFF spring accommodation part 317 of the plunger 13.

(5) Engagement openings 621*a* and 621*b*. Each of them is an opening with a roughly rectangular shapes, disposed through the actuator upper part 62*a* or 62*b* at its rough center. They engage with the engagement protrusions 311*a* and 311*b* of the plunger 13. The engagement openings 621*a* and 621*b* have heights in a vertical direction slightly greater than heights in the vertical direction of the engagement protrusions 311*a* and 311*b*. The engagement openings 621*a* and 621*b* have widths in ±A directions greater than widths in ±A directions of the engagement protrusions 311*a* and 311*b*, so as to allow the actuator 16 to move in ±A directions against the plunger 13.

(6) Guide projection strips 622*a* to 622*d*. Each of them is a linear protrusion roughly parallel to ±A directions, protruding outward from the actuator upper parts 62*a* or 62*b*. They engage with the guide grooves 251*b*, 251*d* and 252*b* of the case 12, so as to guide movement of the actuator 16 in ±A directions. The guide projection strip 622*a* is disposed on a left side face of the actuator upper part 62*a* at its upper end, and engages with the guide groove 252*b*. The guide projection strip 622*b* is disposed on a right side face of the actuator upper part 62*b* at its upper end, and engages with the guide groove 251*b*. The guide projection strips 622*c* and 622*d* are linearly disposed on a right side face of the actuator upper part 62*b* at its rough middle, and engage with the guide groove 251*d*. In the cover 122, no groove is formed corresponding to the guide groove 251*d*. So, in assembling the trigger switch 10, erroneous attempt to inversely mount the actuator 16 causes interference of the guide projection strips 622*c* and 622*d* with the cover 122, and thereby the attempt fails. This enable to prevent misassembling.

It is noted that left and right ends of the actuator body 61 engage with the guide grooves 251*c* and 252*c* of the case 12.

(7) A slide accommodation part 631. It is a penetrating hole with a roughly rectangular shape, provided through the actuator plate 63 near its upper end. The sliding part 64 is press-fitted and fixed to it.

(8) Engagement parts 632*a* and 632*b*. Each of them is a concavity recessed from a left side face of the actuator plate 63 toward the right direction, adjacently communicating with the slide accommodation part 631 below it. They engage with engagement parts 642*a* and 642*b*, shown in FIG. 8, of the sliding part 64.

(9) Engagement parts 633*a* and 633*b*. Each of them is a concavity recessed from a right side face of the actuator plate 63 toward the left direction, adjacently communicating with the slide accommodation part 631 in ±A directions against it. They engage with press fit projections 643*a* and 643*b*, shown in FIG. 8, of the sliding part 64.

(10) A penetrating hole 635. It is a hole with roughly rectangular shape, penetrating in the left and right directions through the actuator plate 63 relatively near its lower side. The movable contact 18 is inserted through it. The penetrating hole 635 has a width in ±A directions greater than a height in a vertical direction.

(11) A holding spring accommodation part 636. It adjacently communicates with the penetrating hole 635 in −A direction against it. It accommodates the holding spring 193 of the quick movement mechanism 19. The movable contact 18 inserted through the penetrating hole 635 is biased toward +A direction against the actuator 16 by the holding spring 193 accommodated in the holding spring accommodation part 636. And,

(12) a ridge part 637. It is a protrusion with a circular column's side face shape, extending along the vertical direction, and swollen toward −A direction from an inner wall face in +A direction of the penetrating hole 635. It receives the movable contact 18 biased toward +A direction by the holding spring 193 in front of the holding spring 193 in +A direction.

Figure 8:
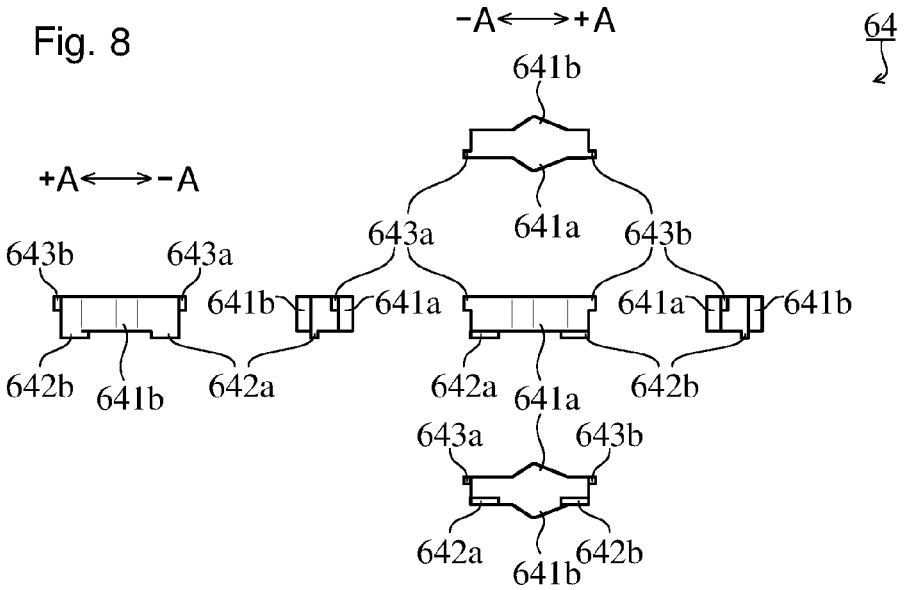
FIG. 8 shows a plan view, a left side view, a front view, a right side view, a back view and a bottom view of the sliding part.

As shown in FIG. 8, the sliding part 64 includes the followings.

(1) Hill parts 641*a* and 641*b*. Each of them is a protrusion swollen toward a left or right direction from a body of the sliding part 64, extending along the vertical direction. They touch the actuator tips 191*a* and 191*b*, shown in FIG. 9, of the quick movement mechanism 19, so as to restrict movement in ±A direction of the actuator 16. Preferably, the sliding part 64 is made of materials with high abrasion resistance in order to restrain abrasion of the hill parts 641*a* and 641*b*.

(2) Engagement parts 642*a* and 642*b*. Each of them is a protrusion protruding downward from the body of the sliding part 64 relatively near its left side. They engage with the engagement parts 632*a* and 632*b* of the actuator plate 63. In press-fitting of the sliding part 64 into the slide accommodation part 631, erroneous attempt to mount the sliding part 64 inversely or upside down causes interference of the engagement parts 642*a* and 642*b*, and thereby the attempt fails. This enables to prevent misassembling.

(3) Press fit projections 643*a* and 643*b*. Each of them is a protrusion protruding toward ±A directions from the body of the sliding part 64 relatively near its right side. They engage with the engagement part 633*a* and 633*b* of the actuator plate 63. The whole span in ±A direction of the sliding part 64 including the press fit projections 643*a* and 643*b* is slightly greater than a length in ±A directions of the slide accommodation part 631. When the sliding part 64 is press-fitted into the slide accommodation part 631, the sliding part 64 is inserted into the slide accommodation part 631 from its left side. Although the press fit projections 643*a* and 643*b* interfere the inner wall face of the slide accommodation part 631, the press fit projections 643*a* and 643*b* are forced to pass through it, and finally to engage with the engagement parts 633*a* and 633*b*, which are provided on the right side of the slide accommodation part 631. This enables to firmly fix the sliding part 64 to the actuator plate 63. It should be noted that the sliding part 64 may be not separately formed. It may be integrally formed with the actuator plate 63.

FIG. 9 shows the actuator tip 191*a*. The actuator tip 191*b* has the same shape. The actuator tip 191*a* includes the followings.

(1) A base 911. It has a roughly rectangular plate shape, a length in ±A directions slightly less than a distance between the actuator tip supporting parts 232*a* and 232*b* of the case 12, and a width in the vertical direction slightly less than a height in the vertical direction of the actuator tip supporting parts 232*a* and 232*b*. The shape of the base 911, different from a circular shape, prevents rotation of the base 911.

(2) An engagement projection 913. It is a protrusion with a roughly semi-circular column shape, protruding from a center of the base 911. It touches the hill part 641*a* of the sliding part 64, so as to restrict movement in ±A directions of the actuator 16. The semi-circular column shape of the engagement projection 913, different from a hemisphere shape, makes it touch the hill part 641*a* within a linear shape area. This reduces abrasion of the engagement projection 913. Preferably, the actuator tip 191*a* is made of materials with high abrasion resistance in order to further reduce abrasion of the engagement projection 913. However, excessive hardness of the actuator tip 191*a* causes abrasion of the hill part 641*a* of the sliding part 64, which touches the actuator tip 191*a*. Thus, it is important to select materials appropriate to the materials of the sliding part 64.

(3) Wings 912*a* and 912*b*. Each of them has a roughly rectangular plate shape, and extends roughly perpendicular to the base 911 from an end in ±A directions of the base 911 toward a direction opposite the engagement projection 913. The wings 912*a* and 912*b* sliding on the actuator tip supporting part 232*a* and 232*b* of the case 12 prevents lean of the engagement projection 913. And, (4) a restriction spring supporting part 914. It is a protrusion with a roughly circular column shape, protruding from a center of the base 911 toward a direction same as that of the wings 912*a* and 912*b*. It supports the restriction spring 192*a*. The restriction spring 192*a* is held between the restriction spring supporting part 914 and the restriction spring supporting part 242 of the case 12.

The actuator tips 191*a* and 191*b* are disposed in spaces with roughly rectangular parallelepiped shape formed between the case 12 and the actuator 16. The spaces have upper boundaries defined by the actuator body 61 of the actuator 16, lower boundaries defined by the partition 22 of the case 12, boundaries in +A direction defined by the actuator tip supporting part 231*b* and 232*b*, boundaries in −A direction defined by the actuator tip supporting part 231*a* and 232*a*, and outer boundaries in left and right directions defined by the left and right side walls of the case 12. The spaces face the sliding part 64 in inner directions along the left and right directions. The actuator tips 191*a* and 191*b* are allowed to move in the spaces toward the left and right directions, roughly perpendicular to the ±A directions, and biased inward by the restriction springs 192*a* and 192*b*. In the actuator tips 191*a* and 191*b*, the engagement projection 913 touching the hill parts 641*a* and 641*b* of the sliding part 64 restricts movement in ±A directions of the actuator 16. In other words, the actuator tips 191*a* and 191*b*, restriction springs 192*a* and 192*b*, and sliding part 64 function as a restriction mechanism for restricting movement in ±A directions of the actuator 16.

As shown in FIG. 10, the quick ON spring supporting part 615 has an upper face 651 being a recessed face with a circular column's side face shape curved along an outer periphery of the quick ON spring 195. This enables to securely support the quick ON spring 195 accommodated in the quick ON spring accommodation part 315.

In the same manner, the quick OFF spring supporting part 617 has an upper face 671 being a recessed face with a circular column's side face shape curved along an outer periphery of the quick OFF spring 197. This enables to securely support the quick OFF spring 197 accommodated in the quick OFF spring accommodation part 317.

The quick ON projection 616 has a height $h_6$ roughly equal to a depth $d_5$, shown in FIG. 5, of the quick ON spring accommodation part 315 and a depth $d_6$, shown in FIG. 6, of the quick ON projection accommodation part 316, and greater than a diameter $D_5$, shown in FIG. 5, of the quick ON spring 195. Thereby, an end face in −A direction of the quick ON projection 616 abuts an annular end in +A direction of the quick ON spring 195 at two areas. One of the areas contains a top part of the annular end of the quick ON spring 195, and the other contains a bottom part of that. This enables the quick ON projection 616 to receive straight a biasing force toward +A direction by the quick ON spring 195.

In the same manner, the quick OFF projection 618 has a height $h_8$ roughly equal to a depth $d_7$, shown in FIG. 6, of the quick OFF spring accommodation part 317 and a depth $d_8$, shown in FIG. 5, of the quick OFF projection accommodation part 318, and greater than a diameter $D_7$, shown in FIG. 6, of the quick OFF spring 197. Thereby, an end face in +A direction of the quick OFF projection 618 abuts an annular end in −A direction of the quick OFF spring 197 at two areas. One of the areas contains a top part of the annular end of the quick OFF spring 197, and the other contains a bottom part of that. This enables the quick OFF projection 618 to receive straight a biasing force toward −A direction by the quick OFF spring 197.

As shown in FIG. 11, the ridge part 637 has a curved face shape with a round top. The movable contact 18 biased toward +A direction by the holding spring 193 touches the ridge part 637 in front of the holding spring 193. Thus, an axis around which the movable contact 18 swings in ±B directions is always in front of the holding spring 193.

It is important that the central axis of swing of the movable contact 18 is in front of the holding spring 193. The shape of the ridge part 637 is not important. It is not limited to C-shape. It may be a bent face shape with a sharp top, such as V-shape, or other shapes. The configure to locate the central axis of swing of the movable contact 18 in front of the holding spring 193 is not limited to providing the ridge part 637 on the inner wall face in +A direction of the penetrating hole 635. For example, it may be providing a ridge part on a face in +A direction of the movable contact 18.

Figure 12:
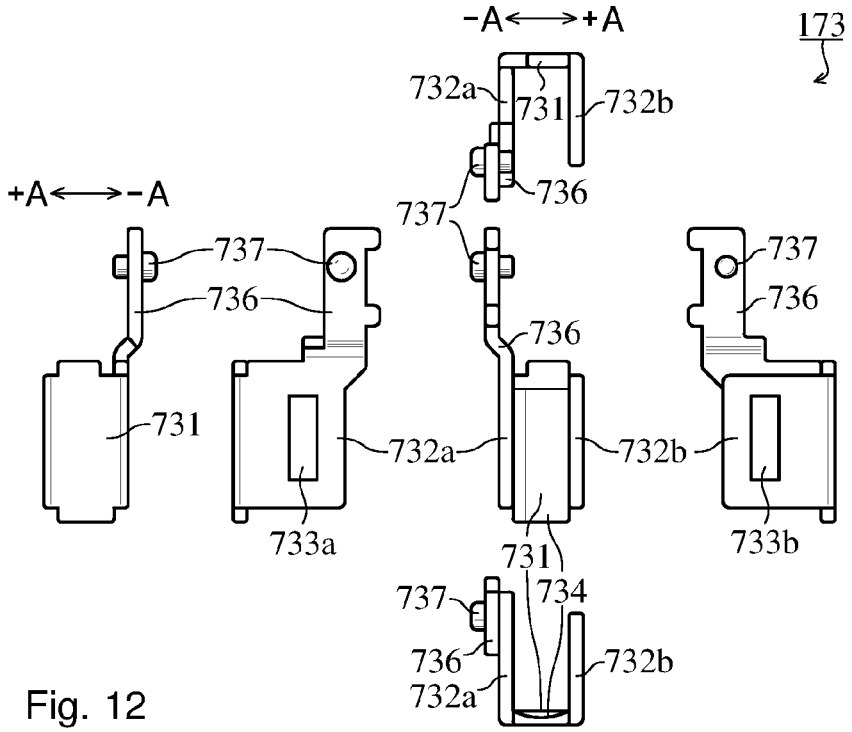
FIG. 12 shows a plan view, a left side view, a front view, a right side view, a back view and a bottom view of an ON terminal or an OFF terminal.

FIG. 12 shows the ON terminal 173. The OFF terminal 171 has a mirror image shape of the ON terminal 173, and will be explained with explanation of the ON terminal 173 simultaneously. In the explanation below, description about the OFF terminal 171 will be enclosed by square brackets ("[ ]"). The ON terminal 173 [the OFF terminal 171] is formed of conductor such as metal, and includes the followings.

(1) A base 731 [711]. It has a roughly rectangular plate shape, and touches a wire to be connected to the ON terminal 173 [the OFF terminal 171] so as to be electrically connected with it. It includes a recess 734 [714] on a part touching the wire. This enhances touching surface with the wire, so as to make contact resistance small.

(2) Wings 732*a* and 732*b* [712*a* and 712*b*]. Each of them has a roughly rectangular plate shape, and continuously extends roughly perpendicular to the base 731 [711] from an end in ±A directions of the base 731 [711]. They include engagement openings 733*a* and 733*b* [713*a* and 713*b*] with roughly rectangular shapes. And, (3) a fixed contact 736 [716]. It has a plate shape continuously extending upward from an upper end of the wing 732*a* in −A direction [the wing 712*b* in +A direction]. It winds along the passage 215 of the case 12. It has a contact 737 [717] near its upper end. The contact 737 [717] is formed of materials with low contact resistance and excellent abrasion resistance, and touches the movable contact 18 so as to be electrically connected with it.

Figure 13:
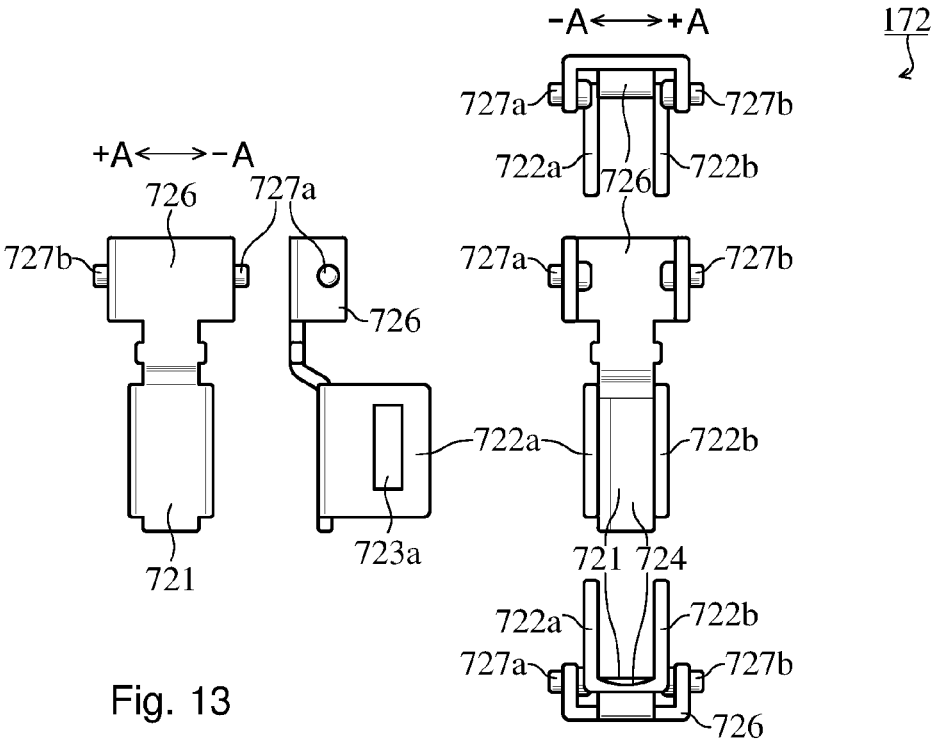
FIG. 13 shows a plan view, a left side view, a front view, a right side view and a bottom view of a common terminal.

As shown in FIG. 13, the common terminal 172, formed of conductor such as metal, includes the followings.

(1) A base 721. It has a roughly rectangular plate shape, and touches a wire to be connected to the common terminal 172 so as to be electrically connected with it. It includes a recess 724 on a part touching the wire. This enhances touching surface with the wire, so as to make contact resistance small.

(2) Wings 722*a* and 722*b*. Each of them has a roughly rectangular plate shape continuously extending roughly perpendicular to the base 721 from ends in ±A directions of the base 721. They have engagement openings 723*a* and 723*b* with roughly rectangular shapes. And, (3) a fixed contact 726. It has a plate shape continuously extending upward from an upper end of the base 721. It winds along the passage 214 of the case 12. It has an upper end branching toward ±A directions. Each branch has a contact 727*a* or 727*b* near its distal end. The contact 727*a* and 727*b* is formed of materials with low contact resistance and excellent abrasion resistance, and touches the movable contact 18 so as to be electrically connected with it.

Figure 14:
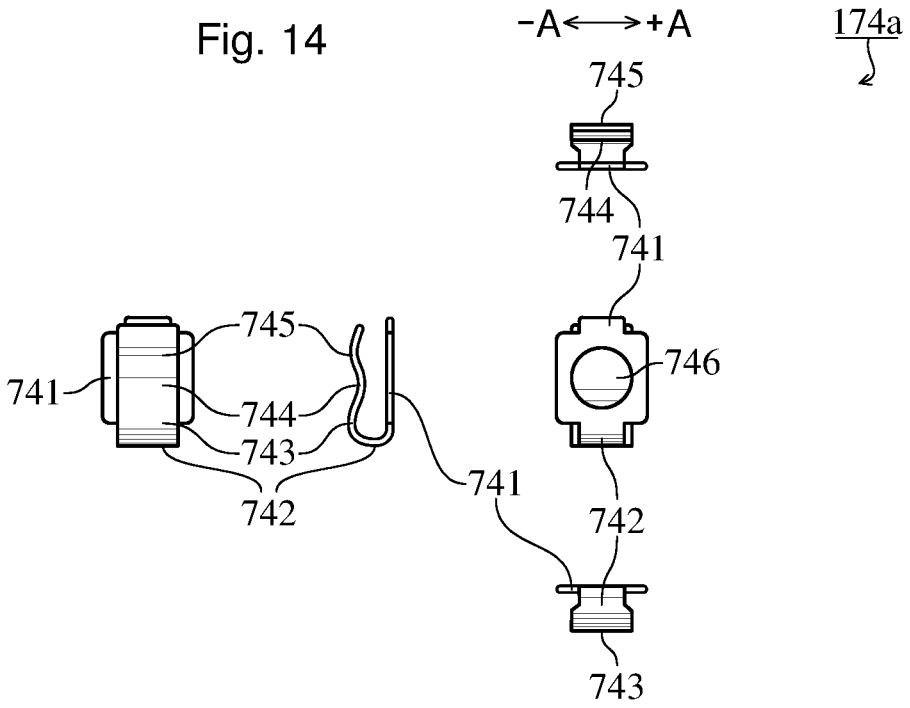
FIG. 14 shows a plan view, a left side view, a front view and a right side view of a connection metal.

FIG. 14 shows the connection metal 174*a*. The connection metals 174*b* and 174*c* has the same shape. The connection metal 174*a* includes the followings.

(1) A engagement part 741. It has a roughly rectangular plate shape, and engages with the engagement openings 713*a* and 713*b* of the OFF terminal 171. It has a screw insertion hole 746 at its rough center. Through the screw insertion hole 746, A distal end of the connection screw 175*a*, shown in FIG. 1, screwed to the case 12 is inserted.

(2) A bend 742. It continuously extends downward from the engagement part 741. It is bent like U-shape, and points upward at its distal end.

(3) A pressing hill part 743. It continuously extends upward from the distal end of the bend 742, and curves swollen toward the left side. It presses the wire connected to the OFF terminal 171, so as to prevent disconnection of the wire.

(4) A valley part 744. It continuously extends upward from a distal end of the pressing hill part 743, and curves swollen toward the right side. It is pressed by a distal end of the connection screw inserted through the screw insertion hole 746. And, (5) a pressing hill part 745. It continuously extends upward from a distal end of the valley part 744, and curves swollen toward the left side. It presses the wire connected to the OFF terminal 171, so as to prevent disconnection of the wire. The swelling of the pressing hill part 745 is smaller than that of the pressing hill part 743.

The force applied to the valley part 744 by the connection screw 175*a* is deployed to the two pressing hill parts 743 and 745. The pressing hill parts 745 is a free end, while the pressing hill parts 743 is connected to the bend 742. Thus, the pressing hill parts 745 moves longer than the pressing hill parts 743 does. When it is pressed by the connection screw 175*a*, the difference of sizes of the swellings cancels out the difference of the movement, so that a distance between a top of the pressing hill parts 745 and the base 711 of the OFF terminal 171 becomes roughly equal to a distance between a top of the pressing hill parts 743 and the base 711 of the OFF terminal 171. This enables to roughly equalize pressing forces applied by the two pressing hill parts 743 and 745 to the wire inserted between the OFF terminal 171 and the connection metal 174*a*, and thereby to securely prevent disconnection of the wire.

Figure 15:
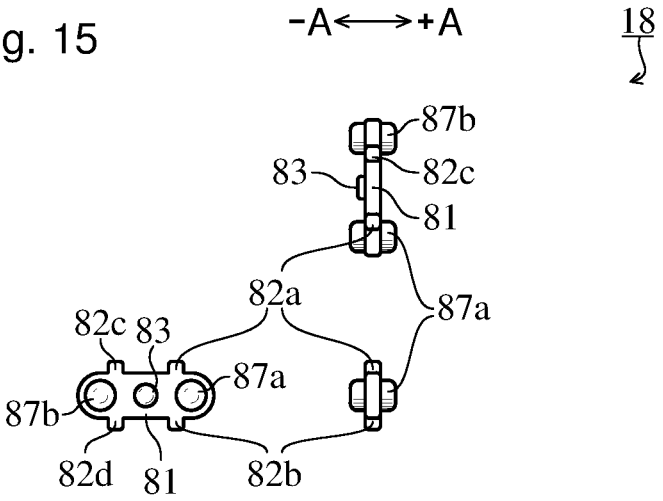
FIG. 15 shows a plan view, a front view and a right side view of a movable contact.

As shown in FIG. 15, the movable contact 18, formed of conductor such as metal, includes the followings.

(1) A base 81. It has an oblong and flat plate shape, and a width in the vertical direction slightly less than a height in the vertical direction of penetrating hole 635 of the actuator plate 63.

(2) Engagement projections 82*a* to 82*d*. Each of them is a projection protruding outward in the vertical direction from an upper or lower edge of the base 81. A distance between the two engagement projections 82*a* and 82*c*, and a distance between the two engagement projections 82*b* and 82*d* are slightly greater than a thickness in the left and right directions of the actuator plate 63 of the plunger 13. A whole width in the vertical direction of the movable contact 18 including the engagement projections 82*a* to 82*d* is greater than a height in the vertical direction of the penetrating hole 635 of the actuator plate 63, but less than a width in ±A directions of the penetrating hole 635. Laying down the movable contact 18 enables the movable contact 18 to be inserted into the penetrating hole 635. Then standing up the movable contact 18 inserted into the penetrating hole 635 makes the actuator plate 63 held between the engagement projections 82*a* to 82*d*, so as to prevent the movable contact 18 from slipping toward the left or right direction.

(3) A holding spring supporting part 83. It is a protrusion protruding toward −A direction from a rough center of a face in −A direction of the base 81. It engages with an end in +A direction of the holding spring 193, so as to support the holding spring 193. And, (4) contacts 87*a* and 87*b*. Each of them is disposed near a left or right end of the base 81. It is formed of materials with low contact resistance and excellent abrasion resistance. It touches the contact 717 of the OFF terminal 171, the contacts 727*a* and 727*b* of the common terminal 172, and the contact 737 of the ON terminal 173, so as to be electrically connected to them.

Figure 16:
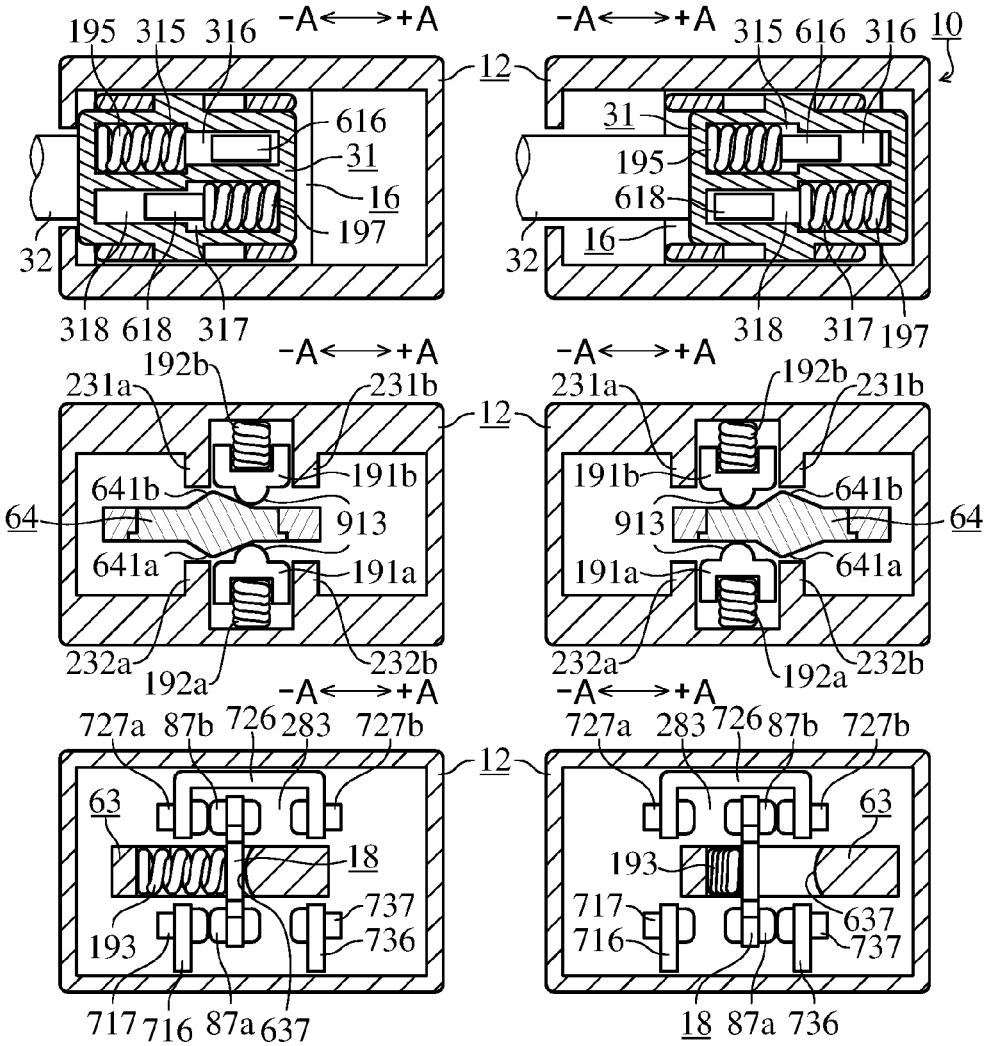
FIG. 16 shows a sectional plan view of operation of the trigger switch.

Next, behavior of the trigger switch 10 will be explained with FIG. 16. In FIG. 16, the top row shows positional relation of the case 12, the plunger 13 and the actuator 16. The middle row shows positional relation of the sliding part 64 and the actuator tips 191*a* and 191*b*. The bottom row shows positional relation of the movable contact 18, the OFF terminal 171, the common terminal 172 and the ON terminal 173. The left column shows an OFF state. The right column shows an ON state.

<OFF State: When the User of the Electric Power Tool Releases the Trigger>

The plunger 13 is biased toward −A direction by the return spring 14, so as to be held against the inner wall in −A direction of the case 12.

The actuator 16 is located relatively nearer to +A direction against the plunger 13. The quick OFF projection 618 partially enters the quick OFF spring accommodation part 317, so as to be biased toward −A direction by the quick OFF spring 197. The quick ON projection 616 is located in the quick ON projection accommodation part 316. The quick ON spring 195 cannot enter the quick ON projection accommodation part 316. So, a biasing force of the quick ON spring 195 is not applied to the quick ON projection 616. Thereby, the whole of the actuator 16 is biased toward −A direction.

In this state, the hill parts 641*a* and 641*b* of the sliding part 64 are located nearer to −A direction than the engagement projections 913 of the actuator tips 191*a* and 191*b* are.

The movable contact 18 abuts the ridge part 637 of the actuator plate 63. Since the actuator 16 is biased toward −A direction, the movable contact 18 is also biased toward −A direction. The contact 87*a* is held against the contact 717 of the OFF terminal 171. The contact 87*b* is held against the contact 727*a* of the common terminal 172. Thereby, the movable contact 18 touches the fixed contact 716 of the OFF terminal 171 and the fixed contact 726 of the common terminal 172, so as to be electrically connected to them, and to bridge the fixed contacts 716 and 726 (OFF fixed contacts).

The contact room 282, shown in FIG. 3, includes a movable contact room 283 therein surrounded by the fixed contacts 716, 726 and 736. The movable contact 18 moves in the movable contact room 283. All areas where the movable contact 18 and the fixed contact 716, 726 and 736 touch each other are in the movable contact room 283.

The OFF state is a state where the actuator 16 is located the nearest to −A direction against the case 12. An end in +A direction of the actuator plate 63 does not enter the movable contact room 283. Thus, the actuator plate 63 always exists between the fixed contacts 726 and 736, which define the movable contact room 283 in +A direction, so as not to widely open between them. Thereby, in rare case that dust, water or the like invade the case 12, they are prevented from invading the movable contact room 283. This enables to prevent occurrence of poor contacting.

<OFF State to Transition State: When the User Pulls the Trigger a Little>

The plunger 13 slightly moves toward +A direction with overcoming the biasing force applied by the return spring 14.

The movement of the plunger 13 toward +A direction causes the actuator 16 to relatively move toward −A direction against the plunger 13. The quick OFF projection 618 leaves the quick OFF spring accommodation part 317, so as to be released from the biasing force applied by the quick OFF spring 197, because the quick OFF spring 197 cannot enter the quick OFF projection accommodation part 318. In contrast, the quick ON projection 616 partially enter the quick ON spring accommodation part 315, so as to be biased toward +A direction by the quick ON spring 195. Thereby, the whole of the actuator 16 is biased toward +A direction.

However, the location of the hill parts 641*a* and 641*b* of the sliding part 64 nearer to −A direction than that of the engagement projection 913 of the actuator tips 191*a* and 191*b* causes slopes in +A direction of the hill parts 641*a* and 641*b* to abut the engagement projection 913. The actuator tips 191*a* and 191*b* being biased inward by the restriction spring 192*a* and 192*b* blocks movement in +A direction of the actuator 16. This makes the movement toward +A direction of the actuator 16 smaller than the movement toward +A direction of the plunger 13. The actuator 16 relatively moves toward −A direction against the plunger 13, so as to compress the quick ON spring 195 and to accumulate energy in it. The movement toward +A direction of the actuator 16 results in the movable contact 18 leaving the OFF position toward +A direction. The contact 87*a* is parted from the contact 717 of the OFF terminal 171, and the contact 87*b* is parted from the contact 727*a* of the common terminal 172. This removes the bridging between the fixed contact 716 and 726. Moving velocity of the movable contact 18 is relatively slow in this time. However, no arc occurs, since no electric current flows via the movable contact 18.

<Transition State to ON State: When the User Further Pulls the Trigger>

The plunger 13 further moves toward +A direction.

The actuator 16 also further moves toward +A direction. However, the movement smaller than that of the plunger 13 causes relative movement toward −A direction against the plunger 13. When an end in −A direction of the quick OFF projection 618 abuts an inner wall in −A direction of the quick OFF projection accommodation part 318, the actuator 16 cannot relatively move further toward −A direction against the plunger 13, so as to be forced to move toward +A direction.

When the hill parts 641*a* and 641*b* of the sliding part 64 pass over a position of the engagement projection 913, obstruction against movement of the actuator 16 is disappeared. Energy accumulated in the quick ON spring 195 forces the actuator 16 to rapidly move toward +A direction.

The movable contact 18, with biased by the holding spring 193 to be held against the ridge part 637, moves toward +A direction along with the actuator 16. This causes the contact 87*a* to abut the contact 737 of the ON terminal 173, and the contact 87*b* to abut the contact 727*b* of the common terminal 172.

Thereby, the movable contact 18 touches the fixed contact 736 of the ON terminal 173 and the fixed contact 726 of the common terminal 172 so as to be electrically connected to them, and thereby bridging between the fixed contacts 736 and 726 (ON fixed contacts). This realizes connection between electric power source and the motor of the electric power tool, and rotation of the motor.

After the movable contact 18 reaches the ON position to bridge between the fixed contacts 736 and 726, the actuator 16 still moves toward +A direction. The movable contact 18 is parted from the ridge part 637, and relatively moves toward −A direction against the actuator 16. The holding spring 193 biases the movable contact 18 toward +A direction, so as to press the contact 87*a* against the contact 737, and to press the contact 87*b* against the contact 727*b*. This enables to prevent rebounding and thereby separation of the movable contact 18 from the fixed contact 736 and 726 after electric current starts flowing via the movable contact 18. This achieves prevention of arc.

The ON state is a state where the actuator 16 is located the nearest to +A direction against the case 12. An end in −A direction of the actuator plate 63 does not enter the movable contact room 283. Thus, the actuator plate 63 always exists between the fixed contacts 716 and 726, which defines the movable contact room 283 in −A direction, so as not to widely open between them. Thereby, in rare case that dust, water or the like invade the case 12, they are prevented from invading the movable contact room 283. This enables to prevent occurrence of poor contacting.

<ON State: When the User Slightly Weakens the Force for Pulling the Trigger>

The plunger 13 is biased by the return spring 14, so as to slightly move toward −A direction.

The movement of the plunger 13 toward −A direction causes the actuator 16 to relatively move toward +A direction against the plunger 13. The quick ON projection 616 locates in the quick ON projection accommodation part 316, so as not to be applied biasing force from the quick ON spring 195. The quick OFF projection 618 partially enter the quick OFF spring accommodation part 317, so as to be biased toward −A direction by the quick OFF spring 197. Thereby, the whole of the actuator 16 is biased toward −A direction.

However, the location of the hill parts 641*a* and 641*b* of the sliding part 64 nearer to +A direction than that of the engagement projection 913 of the actuator tips 191*a* and 191*b* causes slopes in −A direction of the hill parts 641*a* and 641*b* to abut the engagement projection 913. The actuator tips 191*a* and 191*b* being biased inward by the restriction spring 192*a* and 192*b* blocks movement in −A direction of the actuator 16. This makes the movement toward −A direction of the actuator 16 smaller than the movement toward −A direction of the plunger 13. The actuator 16 relatively moves toward +A direction against the plunger 13, so as to compress the quick OFF spring 197 and to accumulate energy in it.

The movable contact 18 is biased toward +A direction by the holding spring 193, so as not to leave the ON position while the actuator 16 moves toward −A direction. This keeps the movable contact 18 bridging between the fixed contacts 736 and 726.

<ON State to OFF State: When the User Further Weakens the Force for Pulling the Trigger>

The plunger 13 further moves toward −A direction.

The actuator 16 also further moves toward −A direction. However, the movement smaller than that of he plunger 13 causes relative movement toward +A direction against the plunger 13. When an end in +A direction of the quick ON projection 616 abuts an inner wall in +A direction of the quick ON projection accommodation part 316, the actuator 16 cannot relatively move further toward +A direction against the plunger 13, so as to be forced to move toward −A direction.

When the hill parts 641*a* and 641*b* of the sliding part 64 pass over a position of the engagement projection 913, obstruction against movement of the actuator 16 is disappeared. Energy accumulated in the quick OFF spring 197 forces the actuator 16 to rapidly move toward −A direction.

When the movement of the actuator 16 results in the ridge part 637 abutting the movable contact 18, the movable contact 18 cannot further relatively move toward +A direction against the actuator 16, so as to be forced to move toward −A direction. The contact 87*a* is parted from the contact 737 of the ON terminal 173, and the contact 87*b* is parted from the contact 727*b* of the common terminal 172. This removes the bridging between the fixed contacts 736 and 726. Moving velocity of the movable contact 18 in this time is the same as that of the actuator 16. The movable contact 18 is rapidly separated from the fixed contact 736 and 726, so as to prevent arc.

After the movable contact 18 is parted from the fixed contacts 736 and 726, the actuator 16 keeps the rapid movement toward −A direction. The movable contact 18 also keeps the movement along with the actuator 16. Finally, the contact 87*a* abuts the contact 717 of the OFF terminal 171, and the contact 87*b* abuts the contact 727*a* of the common terminal 172. Thereby, the movable contact 18 touches the fixed contact 716 of the OFF terminal 171 and the fixed contact 726 of the common terminal 172, so as to be electrically connected to them, and thereby to bridge between the fixed contacts 716 and 726. The bridging between the fixed contacts 716 and 726 allows regeneration current to flow via the movable contact 18, so as to brake the motor keeping rotation caused by inertia. This achieves quick stop of the rotation of the motor.

If rebounding occurs in a short period before the motor stops, the touching between the movable contact 18 and the fixed contacts 716 and 726 is lost. This may cause arc because electric current is flowing via the movable contact 18. However, the central axis of swing of the movable contact 18 disposed in front of the holding spring 193 enables to prevent rebounding with no spring for biasing the movable contact 18 toward −A direction. The principle will be explained below.

Some factors such as processing accuracy of parts hinder complete elimination of difference between positions in ±A directions of the contacts 717 and 727*a*. Thus, the movable contact 18 in the OFF state is not completely perpendicular to ±A directions, but slightly leans.

Figure 17:
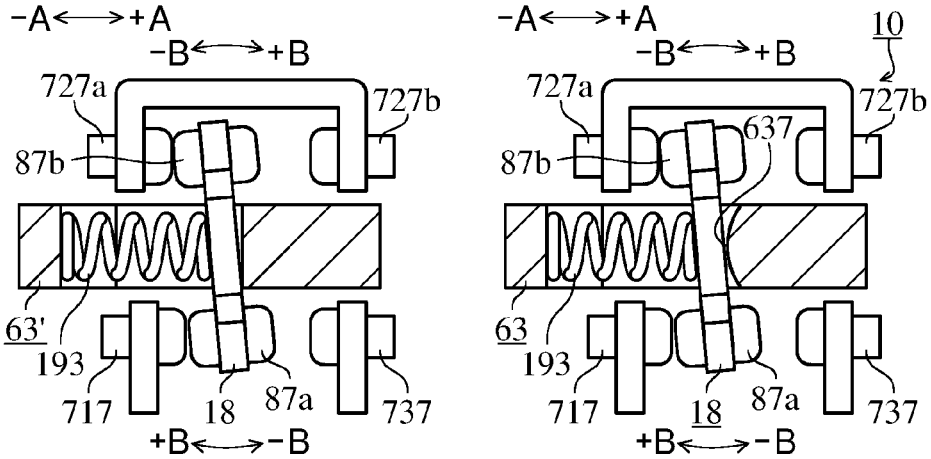
FIG. 17 shows a sectional plan view of a principle of prevention of rebounding.

As shown in a left side of FIG. 17 for comparison, an actuator plate 63' includes an penetrating hole 635 having an inner wall in +A direction with a flat plane shape and no ridge part 637.

It is assumed that the contact 717 is located in +A direction in comparison with the contact 727*a*. When the movable contact 18 arrives, the contact 87*a* touches the contact 717 before the contact 87*b* touches the contact 727*a*. The movable contact 18 receives force toward +A direction from the contact 717 and force toward −A direction from the actuator plate 63. This causes the movable contact 18 swing toward −B direction. Then, the contact 87*b* touches the contact 727*a*, so that the fixed contacts 716 and 726 are bridged.

However, lean of the movable contact 18 causes an edge line, which is a boundary between the inner wall in +A direction of the penetrating hole 635 and a surface of the actuator plate 63 at a side of the contact 717, to function as a fulcrum of the swinging of the movable contact 18. The movable contact 18 receives a force toward +A direction from the holding spring 193, and there is a gap between the movable contact 18 and the actuator plate 63 in front of the holding spring 193. This may cause arc because the movable contact 18 swings toward +B direction so as to temporarily lose touching between the contact 87*b* and 727*a*.

In contrast, the actuator plate 63 according to the present embodiment is provided with the ridge part 637 on the inner wall in +A direction of the penetrating hole 635, as shown in a right side of FIG. 17. Thereby, the ridge part 637 functions as the fulcrum of the swinging of the movable contact 18. The axis of swinging located in front of the holding spring 193 prevents the lean of the movable contact 18 from generating a gap in front of the holding spring 193. Thus, the movable contact 18 does not swing even when it receives the force toward +A direction from the holding spring 193. This achieves prevention of rebounding and arc.

Figure 18:
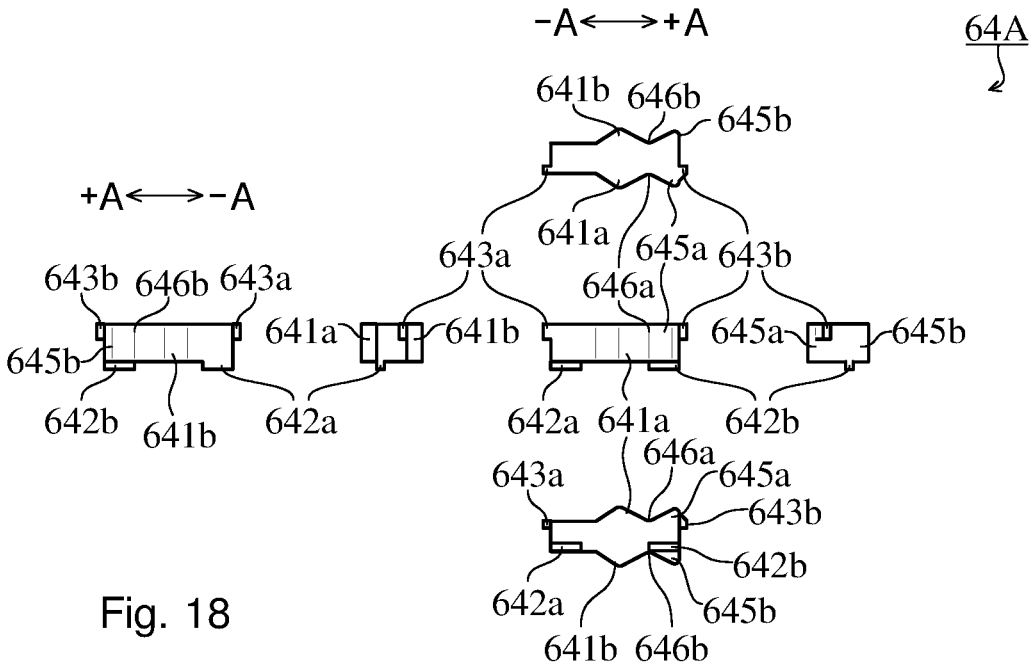
FIG. 18 shows a plan view, a left side view, a front view, a right side view, a back view and a bottom view of another sliding part.

A sliding part 64A shown in FIG. 18 may be used in the trigger switch 10, instead of the sliding part 64 described above. The sliding part 64A further includes hill parts 645*a* and 645*b* in +A direction against the hill parts 641*a* and 641*b*. Thereby, valley parts 646*a* and 646*b* are formed between the hill parts 645*a* and 645*b* and the hill parts 641*a* and 641*b*. Positions of the valley parts 646*a* and 646*b* roughly coincide with positions where the actuator tips 191*a* and 191*b* abut the sliding part 64A in OFF state.

In transition from ON state to OFF state, the actuator 16 rapidly moves toward −A direction. Simultaneously, the positions where the actuator tips 191*a* and 191*b* abut the sliding part 64A relatively move toward +A direction against the sliding part 64A. While the contacts 87*a* and 87*b* of the movable contact 18 touch the contact 717 of the OFF terminal 171 and the contact 727*a* of the common terminal 172, the positions where the actuator tips 191*a* and 191*b* abut the sliding part 64A pass over the valley part 646*a* and 646*b* at roughly the same time. Then, the actuator tips 191*a* and 191*b* abut the hill part 645*a* and 645*b*, so as to brake the movement toward −A direction of the sliding part 64A.

This diminishes momentum when the contacts 87*a* and 87*b* touch the contacts 717 and 727*a*. This enhances effect of restraining rebounding of the movable contact 18 and prevention of arc.

It should be noted that the positions of the valley part 646*a* and 646*b* may not be the positions where the actuator tips 191*a* and 191*b* abut the sliding part 64A in OFF state. It may be slightly in +A direction against the positions. This enables to brake the movement toward −A direction of the sliding part 64A before the contacts 87*a* and 87*b* touch the contacts 717 and 727*a*. This achieves more diminishment of the momentum when the contacts 87*a* and 87*b* touch the contacts 717 and 727*a*, and thereby more enhancement of the effect of restraining rebounding of the movable contact 18 and prevention of arc.

The above described embodiments are examples to make it easier to understand the present invention. The present invention is not limited to the example, and includes any modified, altered, added, or removed variations, without departing from the scope of the claims attached herewith. This can be easily understood by persons skilled in the art.

REFERENCE SIGNS LIST

10: trigger switch; 12: case; 121: case body; 122: cover; 13: plunger; 14: return spring; 15: dustproof mechanism; 151: packing; 152: sponge; 16: actuator; 17: terminal part; 171: OFF terminal; 172: common terminal; 173: ON terminal; 174*a* to 174*c*: connection metal; 175*a* to 175*c*: connection screw; 18: movable contact; 19: quick movement mechanism; 191*a* and 191*b*: actuator tip; 192*a* and 192*b*: restriction spring; 193: holding spring; 195: quick ON spring; 197: quick OFF spring; 21 and 22: partition; 211, 212, 221 and 222: partition part; 213 to 215: passage; 231*a*, 231*b*, 232*a* and 232*b*: actuator tip supporting part; 241, 242 and 914 restriction spring supporting part; 251*a* to 251*d* and 252*a* to 252*c*: guide groove; 28: switch room; 281 plunger room; 282 contact room; 283; movable contact room; 29: wire room; 31: plunger body; 311*a* and 311*b*: engagement protrusion; 312: return spring accommodation part; 313*a* to 313*c*: slide projection strip; 314*a* to 314*d*: guide wing; 315: quick ON spring accommodation part; 316: quick ON projection accommodation part; 317: quick OFF spring accommodation part; 318: quick OFF projection accommodation part; 32: operation part; 351*a* and 351*b*: quick ON spring accommodation inner wall face; 352*a* and 352*b*: quick ON spring supporting inner wall face; 353*a* and 353*b*: quick ON projection reception inner wall face; 354, 364, 374 and 384: bottom face; 363*a*, 363*b*, 383*a* and 383*b*: inner wall face; 371*a* and 371*b*: quick OFF spring accommodation inner wall face; 372*a* and 372*b*: quick OFF spring supporting inner wall face; 373*a* and 373*b*: quick OFF projection reception inner wall face; 61: actuator body; 615: quick ON spring supporting part; 616: quick ON projection; 617: quick OFF spring supporting part; 618: quick OFF projection; 62*a* and 62*b*: actuator upper part; 621*a*, 621*b*, 713*a*, 713*b*, 723*a*, 723*b*, 733*a* and 733*b*: engagement opening; 622*a* to 622*d*: guide projection strip; 63 actuator plate; 631: slide accommodation part; 632*a*, 632*b*, 633*a*, 633*b*, 642*a*, 642*b* and 741: engagement part; 635: penetrating hole; 636: holding spring accommodation part; 637: ridge part; 64 and 64A: sliding part; 641*a*, 641*b*, 645*a* and 645*b*: hill part; 643*a* and 643*b* press fit projection; 646*a*, 646*b* and 744: valley part; 651 and 671: upper face; 711, 721, 731, 81 and 911: base; 712*a*, 712*b*, 722*a*, 722*b*, 732*a*, 732*b*, 912*a* and 912*b*: wing; 714, 724 and 734: recess; 716, 726 and 736: fixed contact; 717, 727*a*, 727*b*, 737, 87*a* and 87*b*: contact; 742: bend; 743 and 745: pressing hill part; 746: screw insertion hole; 82*a* to 82*d* and 913: engagement projection; and 83: holding spring supporting part.

The invention claimed is:

1. A switch, comprising:

an actuator, allowed to move toward an ON direction and toward an OFF direction opposite the ON direction;

a movable contact, engaging with the actuator;

a fixed contact, configured to touch the movable contact with electrical connection when the movable contact is located at an ON position, and to be apart from the movable contact with electrical isolation when the movable contact is located at positions other than the ON position;

an arc prevention mechanism, configured to prevent generation of arc between the movable contact and the fixed contact; and a plunger, allowed to move toward the ON direction and toward the OFF direction, wherein the actuator engages with the plunger to be allowed to move toward the ON direction and toward the OFF direction against the plunger, the arc prevention mechanism comprises:

a quick ON spring, comprising a helical compression spring to bias the actuator toward the ON direction against the plunger;

a quick OFF spring, comprising a helical compression spring to bias the actuator toward the OFF direction against the plunger; and a restriction mechanism, configured to restrict movement of the actuator before the actuator passes over a switching position, and to release the actuator after the actuator passes over the switching position, the plunger comprises:

a quick ON spring accommodation part, accommodating the quick ON spring;

a quick ON projection accommodation part, disposed in the ON direction with respect to the quick ON spring accommodation part;

a quick OFF spring accommodation part, disposed at a location so as to be free from overlap with the quick ON spring accommodation part in the ON direction and the OFF direction, and accommodating the quick OFF spring; and a quick OFF projection accommodation part, disposed in the OFF direction with respect to the quick OFF spring accommodation part, and the actuator comprises:

a quick ON projection, accommodated in the quick ON projection accommodation part and movable toward the ON direction and the OFF direction within the quick ON projection accommodation part, the quick ON projection being biased toward the ON direction by the quick ON spring; and a quick OFF projection, accommodated in the quick OFF projection accommodation part and movable toward the ON direction and the OFF direction within the quick OFF projection accommodation part, the quick OFF projection being biased toward the OFF direction by the quick OFF spring.

2. The switch of claim 1, wherein the quick ON projection is a protrusion protruding toward a direction different from the ON direction and the OFF direction, and has a roughly rectangular parallelepiped shape, a width smaller than a diameter of the quick ON spring, and a height larger than the diameter of the quick ON spring, the quick OFF projection is a protrusion protruding toward a direction different from the ON direction and the OFF direction, and has a roughly rectangular parallelepiped shape, a width smaller than a diameter of the quick OFF spring, and a height larger than the diameter of the quick OFF spring, the quick ON projection accommodation part is a concavity with an opening in a direction opposite the direction toward which the quick ON projection protrudes, and has a width smaller than the diameter of the quick ON spring, the quick OFF projection accommodation part is a concavity with an opening in a direction opposite the direction toward which the quick OFF projection protrudes, and has a width smaller than the diameter of the quick OFF spring, the quick ON spring accommodation part is a concavity with an opening in a direction roughly the same as the direction of the opening of the quick ON projection accommodation part, has a depth roughly the same as that of the quick ON projection accommodation part, and comprises:

quick ON spring accommodation inner wall faces, having a distance between them roughly the same as the diameter of the quick ON spring;

quick ON spring supporting inner wall faces, continuously extending inward from the quick ON spring accommodation inner wall faces, and curving along an outer periphery of the quick ON spring with a roughly circular column shape; and quick ON projection reception inner wall faces, continuously extending further inward from the quick ON spring accommodation inner wall faces, and having a distance between them roughly the same as the width of the quick ON projection accommodation part, and the quick OFF spring accommodation part is a concavity with an opening in a direction roughly the same as the direction of the opening of the quick OFF projection accommodation part, has a depth roughly the same as that of the quick OFF projection accommodation part, and comprises:

quick OFF spring accommodation inner wall faces, having a distance between them roughly the same as the diameter of the quick OFF spring;

quick OFF spring supporting inner wall faces, continuously extending inward from the quick OFF spring accommodation inner wall faces, and curving along an outer periphery of the quick OFF spring with a roughly circular column shape; and quick OFF projection reception inner wall faces, continuously extending further inward from the quick OFF spring accommodation inner wall faces, and having a distance between them roughly the same as the width of the quick OFF projection accommodation part.

3. The switch of claim 2, wherein the actuator further comprises:

a quick ON spring supporting part, being a protrusion disposed in the OFF direction with respect to the quick ON projection, protruding toward a direction roughly the same as the direction toward which the quick ON projection protrudes, and having a width roughly the same as the width of the quick ON projection, and an upper face recessed along the outer periphery of the quick ON spring with a roughly circular cylindrical shape; and a quick OFF spring supporting part, being a protrusion disposed in the ON direction with respect to the quick OFF projection, protruding toward a direction roughly the same as the direction toward which the quick OFF projection protrudes, and having a width roughly the same as the width of the quick OFF projection, and an upper face recessed along the outer periphery of the quick OFF spring with a roughly circular cylindrical shape.

4. The switch of claim 1, further comprising:

a second fixed contact, configured to touch the movable contact to be electrically connected with the fixed contact via the movable contact when the movable contact is located at the ON position, and to be apart from the movable contact to be electrically isolated from the movable contact and the fixed contact when the movable contact is located at positions other than the ON position;

an OFF fixed contact, configured to touch the movable contact with electrical connection when the movable contact is located at an OFF position in the OFF direction with respect to the ON position, and to be apart from the movable contact with electrical isolation when the movable contact is located at positions other than the OFF position; and a second OFF fixed contact, configured to touch the movable contact to be electrically connected with the OFF fixed contact via the movable contact when the movable contact is located at the OFF position, and to be apart from the movable contact to be electrically isolated from the movable contact and the OFF fixed contact when the movable contact is located at positions other than the OFF position, wherein the arc prevention mechanism further comprises a holding spring, comprising a helical compression spring, biasing the movable contact toward the ON direction against the actuator, to hold the movable contact in the ON position when the actuator is located in the ON direction of the switching position, the actuator further comprises an actuator plate, intervening between the fixed contact and the second fixed contact and between the OFF fixed contact and the second OFF fixed contact, the actuator plate comprises:

a holding spring accommodation part, accommodating the holding spring; and a penetrating hole, disposed in the ON direction with respect to the holding spring accommodation part, the movable contact being inserted through the penetrating hole, and the movable contact is able to swing about a fulcrum in the ON direction against the holding spring when the movable contact touches an inner wall face in the ON direction of the penetrating hole by being biased by the holding spring.

5. The switch of claim 4, wherein the penetrating hole comprises a ridge part, swollen toward the OFF direction from the inner wall face in the ON direction, the ridge part forming the fulcrum of the swing of the movable contact.

6. A switch, comprising:

an actuator, allowed to move toward an ON direction and toward an OFF direction opposite the ON direction;

a movable contact, engaging with the actuator;

a fixed contact, configured to touch the movable contact with electrical connection when the movable contact is located at an ON position, and to be apart from the movable contact with electrical isolation when the movable contact is located at positions other than the ON position;

an arc prevention mechanism, configured to prevent generation of arc between the movable contact and the fixed contact;

a second fixed contact, configured to touch the movable contact to be electrically connected with the fixed contact via the movable contact when the movable contact is located at the ON position, and to be apart from the movable contact to be electrically isolated from the movable contact and the fixed contact when the movable contact is located at positions other than the ON position;

an OFF fixed contact, configured to touch the movable contact with electrical connection when the movable contact is located at an OFF position in the OFF direction with respect to the ON position, and to be apart from the movable contact with electrical isolation when the movable contact is located at positions other than the OFF position;

a second OFF fixed contact, configured to touch the movable contact to be electrically connected with the OFF fixed contact via the movable contact when the movable contact is located at the OFF position, and to be apart from the movable contact to be electrically isolated from the movable contact and the OFF fixed contact when the movable contact is located at positions other than the OFF position; and a plunger, allowed to move toward the ON direction and toward the OFF direction, wherein the arc prevention mechanism comprises a holding spring, comprising a helical compression spring, biasing the movable contact toward the ON direction against the actuator, to hold the movable contact in the ON position when the actuator is located in the ON direction of a switching position;

a quick ON spring, comprising a helical compression spring, and biasing the actuator toward the ON direction against the plunger;

a quick OFF spring, comprising a helical compression spring, and biasing the actuator toward the OFF direction against the plunger; and a restriction mechanism, configured to restrict a movement of the actuator before the actuator passes over the switching position, and to release the actuator after the actuator passes over the switching position, the actuator comprises an actuator plate, intervening between the fixed contact and the second fixed contact and between the OFF fixed contact and the second OFF fixed contact, the actuator plate comprises:

a holding spring accommodation part, accommodating the holding spring; and a penetrating hole, disposed in the ON direction with respect to the holding spring accommodation part, the movable contact being inserted through the penetrating hole, the movable contact is able to swing about a fulcrum in the ON direction against the holding spring when the movable contact touches an inner wall face in the ON direction of the penetrating hole by being biased by the holding spring, and the actuator engages with the plunger to be allowed to move toward the ON direction and toward the OFF direction against the plunger.

7. The switch of claim 6, wherein the penetrating hole comprises a ridge part, swollen toward the OFF direction from the inner wall face in the ON direction, the ridge part forming the fulcrum of the swing of the movable contact.

* * * * *